US008833626B2

(12) United States Patent
Perron et al.

(10) Patent No.: US 8,833,626 B2
(45) Date of Patent: Sep. 16, 2014

(54) FASTENING TOOL

(75) Inventors: Donald R. Perron, North Smithfield, RI (US); Keven E. Miller, Wyoming, RI (US); David M. McGee, Attleboro, MA (US); Adair Yang, Taichung (TW); Brian Burke, Barrington, RI (US); Paul Grandstrand, Providence, RI (US); Wai Ho, Providence, RI (US)

(73) Assignee: Stanley Fastening Systems, L.P., North Kingstown, RI (US)

( * ) Notice: Subject to any disclaimer, the term of this patent is extended or adjusted under 35 U.S.C. 154(b) by 456 days.

(21) Appl. No.: 13/247,845

(22) Filed: Sep. 28, 2011

(65) Prior Publication Data

US 2012/0074194 A1 Mar. 29, 2012

Related U.S. Application Data

(60) Provisional application No. 61/387,857, filed on Sep. 29, 2010, provisional application No. 61/433,765, filed on Jan. 18, 2011.

(51) Int. Cl.
*B25C 1/04* (2006.01)
*B25C 1/00* (2006.01)

(52) U.S. Cl.
CPC .. *B25C 1/008* (2013.01); *B25C 1/04* (2013.01)
USPC ..... 227/8; 227/120; 227/130; 227/138

(58) Field of Classification Search
USPC ..... 227/8, 10, 107, 120, 130, 135, 136, 138
See application file for complete search history.

(56) References Cited

U.S. PATENT DOCUMENTS 4,629,106 A 12/1986 Howard et al.
4,716,813 A * 1/1988 Prudencio ..... 91/355
5,083,694 A * 1/1992 Lemos ..... 227/8
(Continued)

FOREIGN PATENT DOCUMENTS

JP 9-29663 2/1997
JP 2005-7546 1/2005

OTHER PUBLICATIONS

International Preliminary Report on Patentability as issued for International Application No. PCT/US2011/053900, dated Oct. 22, 2012.

(Continued)

*Primary Examiner* — Scott A. Smith
(74) *Attorney, Agent, or Firm* — Pillsbury Winthrop Shaw Pittman LLP

(57) ABSTRACT

A fastening tool includes an actuation device configured to actuate a drive engine of the tool to initiate a drive stroke. The actuation device includes a contact trip assembly operatively connected to the movable portion of the nose assembly. The contact trip assembly a lower contact arm connected to the movable portion of the nose assembly biased in the retracted position and movable to the extended position with the moveable portion of the nose assembly, and an upper contact arm operatively connected to the lower contact arm. The actuation device includes a trigger assembly that includes a trigger, a trigger arm pivotally supported by the trigger and configured to interact with the upper contact arm, and a check pawl configured to engage an opening in the upper contact arm when the upper contact arm moves downward to prevent the tool from being operated in a contact trip mode.

22 Claims, 20 Drawing Sheets

(56) References Cited

U.S. PATENT DOCUMENTS

| | | | | |
|---|---|---|---|---|
| 5,180,091 | A | 1/1993 | Ota | |
| 5,191,861 | A * | 3/1993 | Kellerman et al. | 123/46 SC |
| 5,816,468 | A | 10/1998 | Yang | |
| 6,179,192 | B1 | 1/2001 | Weinger et al. | |
| 6,199,739 | B1 | 3/2001 | Mukoyama et al. | |
| 6,209,770 | B1 * | 4/2001 | Perra | 227/8 |
| 6,609,646 | B2 * | 8/2003 | Miller et al. | 227/8 |
| 6,966,476 | B2 | 11/2005 | Jalbert et al. | |
| 7,086,573 | B1 * | 8/2006 | Wen | 227/8 |
| 7,140,524 | B2 * | 11/2006 | Hung et al. | 227/8 |
| 7,143,918 | B2 | 12/2006 | Aguirre et al. | |
| 7,413,103 | B1 | 8/2008 | Ho et al. | |
| 7,506,787 | B2 * | 3/2009 | Wu et al. | 227/8 |
| 7,753,244 | B2 * | 7/2010 | Nagata | 227/120 |
| 8,011,548 | B2 * | 9/2011 | Chang | 227/8 |
| 2006/0249554 | A1 | 11/2006 | Butzen et al. | |
| 2007/0125821 | A1 | 6/2007 | Wang | |
| 2008/0135596 | A1 | 6/2008 | Wu et al. | |
| 2010/0206933 | A1 | 8/2010 | Wu et al. | |

OTHER PUBLICATIONS

Extended Search Report, including the Search Opinion, as issued for European Patent Application No. 13181288.5, dated Oct. 11, 2013.

Copenheaver, Blaine R.—International Search Report on corresponding application PCT/US2011/053900—Feb. 21, 2012—Arlington, Virginia U.S.A.

* cited by examiner

FASTENING TOOL

CROSS-REFERENCE TO RELATED APPLICATIONS

This application claims the benefit of priority from U.S. Provisional Patent Application Ser. No. 61/387,857, filed Sep. 29, 2010, and U.S. Provisional Patent Application Ser. No. 61/433,765, filed Jan. 18, 2011, the entire contents of both of which are incorporated herein by reference.

FIELD

The present application generally relates to a fastening tool having a movable nose that is in a retracted position when at rest.

BACKGROUND

Typical pneumatic fastening tools, such as pneumatic nailers, have a contact arm that extends beyond the tip of the nose, to ensure that actuation of the tool only occurs after the nose and contact arm are in contact with the workpiece. Such an extension of the contact arm may obstruct the view of the operator with respect to the target for the fastener, which may make precise fastener placement difficult.

It is desirable to have a reduced level of obstruction between the nose of the tool and the workpiece.

SUMMARY

According to an aspect of at least one embodiment of the present invention, there is provided a fastening tool that includes a housing having an engine receiving portion, and a drive engine located in the engine receiving portion. The drive engine includes a cylinder and a piston reciprocally mounted within the cylinder. The piston includes a driver configured to move along a drive axis to drive a fastener during a drive stroke. The tool also includes a nose assembly carried by the housing. The nose assembly includes a fastener drive track configured to receive the driver, and a movable portion biased in a retracted position towards the housing and movable to an extended position away from the housing. The tool further includes a magazine assembly is constructed and arranged to feed successively leading fasteners from a supply of fasteners contained therein into the drive track, and an actuation device configured to actuate the drive engine to initiate the drive stroke. The actuation device includes a contact trip assembly operatively connected to the movable portion of the nose assembly. The contact trip assembly includes a lower contact arm connected to the movable portion of the nose assembly biased in the retracted position and movable to the extended position with the moveable portion of the nose assembly, and an upper contact arm operatively connected to the lower contact arm. The actuation device also includes a trigger assembly that includes a trigger, a trigger arm pivotally supported by the trigger and configured to interact with the upper contact arm, and a check pawl configured to engage an opening in the upper contact arm when the upper contact arm moves downward to prevent the tool from being operated in a contact trip mode.

According to an aspect of at least one embodiment of the present invention, there is provided an actuation device for a fastening tool that includes a drive engine. The actuation device is configured to actuate the drive engine to initiate a drive stroke. The actuation device includes a contact trip assembly operatively connected to a movable portion of a nose assembly of the fastening tool, and biased in the retracted position and movable to the extended position with the moveable portion of the nose assembly. The contact trip assembly includes a lower contact arm connected to the movable portion of the nose assembly, and an upper contact arm operatively connected to the lower contact arm. The actuation device also includes a trigger assembly that includes a trigger, a trigger arm pivotally supported by the trigger and configured to interact with the upper contact arm, and a check pawl configured to engage an opening in the upper contact arm when the upper contact arm moves downward to prevent the tool from being operated in a contact trip mode.

According to an aspect of at least one embodiment of the present invention, there is provided a fastening tool that includes a housing having an engine receiving portion, and a drive engine located in the engine receiving portion. The drive engine includes a cylinder and a piston reciprocally mounted within the cylinder. The piston includes a driver configured to move along a drive axis to drive a fastener during a drive stroke. The fastening tool includes a nose assembly carried by the housing. The nose assembly includes a fastener drive track configured to receive the driver, and a movable portion biased in a retracted position towards the housing and movable to an extended position away from the housing. The fastening tool includes a magazine assembly constructed and arranged to feed successively leading fasteners from a supply of fasteners contained therein into the drive track, and an actuation device configured to actuate the drive engine to initiate the drive stroke. The actuation device includes a contact trip assembly operatively connected to the movable portion of the nose assembly. The contact trip assembly includes a lower contact arm connected to the movable portion of the nose assembly biased in the retracted position and movable to the extended position with the moveable portion of the nose assembly, and an upper contact arm operatively connected to the lower contact arm. The actuation device also includes a trigger assembly that includes a trigger, a trigger arm pivotally supported by the trigger and configured to interact with the upper contact arm. The fastening tool includes a dry fire lockout configured to prevent initiation of the drive stroke when a predetermined number of fasteners are in the magazine assembly.

In at least one embodiment, the actuation device also includes a mode selector configured to lock the check pawl in a contact trip mode position to prevent the check pawl from engaging the opening in the upper contact arm when the upper contact arm moves downward.

In at least one embodiment, the mode selector is configured to position the check pawl in a sequential mode position to allow the check pawl to engage the opening in the upper contact arm when the upper contact arm moves downward.

In at least one embodiment, the trigger is pivotally mounted to the housing.

In at least one embodiment, the fastening tool also includes a trigger guide supported by the magazine assembly, and the trigger is supported by the trigger guide and is configured to slide linearly relative to the trigger guide.

In at least one embodiment, the fastening tool also includes a dry fire lockout configured to prevent initiation of the drive stroke when a predetermined number of fasteners are in the magazine assembly.

In at least one embodiment, the dry fire lockout is configured to prevent movement of the trigger.

In at least one embodiment, the dry fire lockout includes a first portion configured to extend into the magazine assembly and a second portion supported by the first portion and configured to interact with the trigger.

In at least one embodiment, the magazine assembly includes a pusher, and when the first portion of the dry fire lockout is engaged with the pusher, movement of the trigger is prevented.

In at least one embodiment, the magazine assembly includes a pusher, and the dry fire lockout includes a protrusion extending from the pusher towards the nose assembly, a lever positioned in the magazine assembly, and a pin connected to the lever, the pin being configured to connect the lower contact arm and the upper contact arm when more than the predetermined number of fasteners are in the magazine assembly and to disconnect the lower contact arm from the upper contact arm when the protrusion moves the lever when the predetermined number of fasteners are in the magazine assembly.

In at least one embodiment, the predetermined number of fasteners is zero.

These and other aspects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification. In addition, it should be appreciated that structural features shown or described in any one embodiment herein can be used in other embodiments as well. As used in the specification and in the claims, the singular form of "a", "an", and "the" include plural referents unless the context clearly dictates otherwise. In addition, where the specification refers to directions, such as "upward" and "downward," it should be understood that such directions are with respect to one orientation of the tool, and if the tool is used in another orientation, the directions become relative to the workpiece and the tool, i.e., upward being towards the tool and away from the workpiece, and downward being away from the tool and towards the workpiece, as will be apparent to one of ordinary skill in the art.

BRIEF DESCRIPTION OF THE DRAWINGS

Features of the fastening tool in accordance with one embodiment are shown in the drawings, in which like reference numerals designate like elements. In one embodiment, the structural components illustrated herein are drawn to scale. It is to be expressly understood, however, that the drawings are for the purpose of illustration and description only and are not a limitation of the invention. The drawings form part of this original disclosure in which.

DETAILED DESCRIPTION

Figure 1:
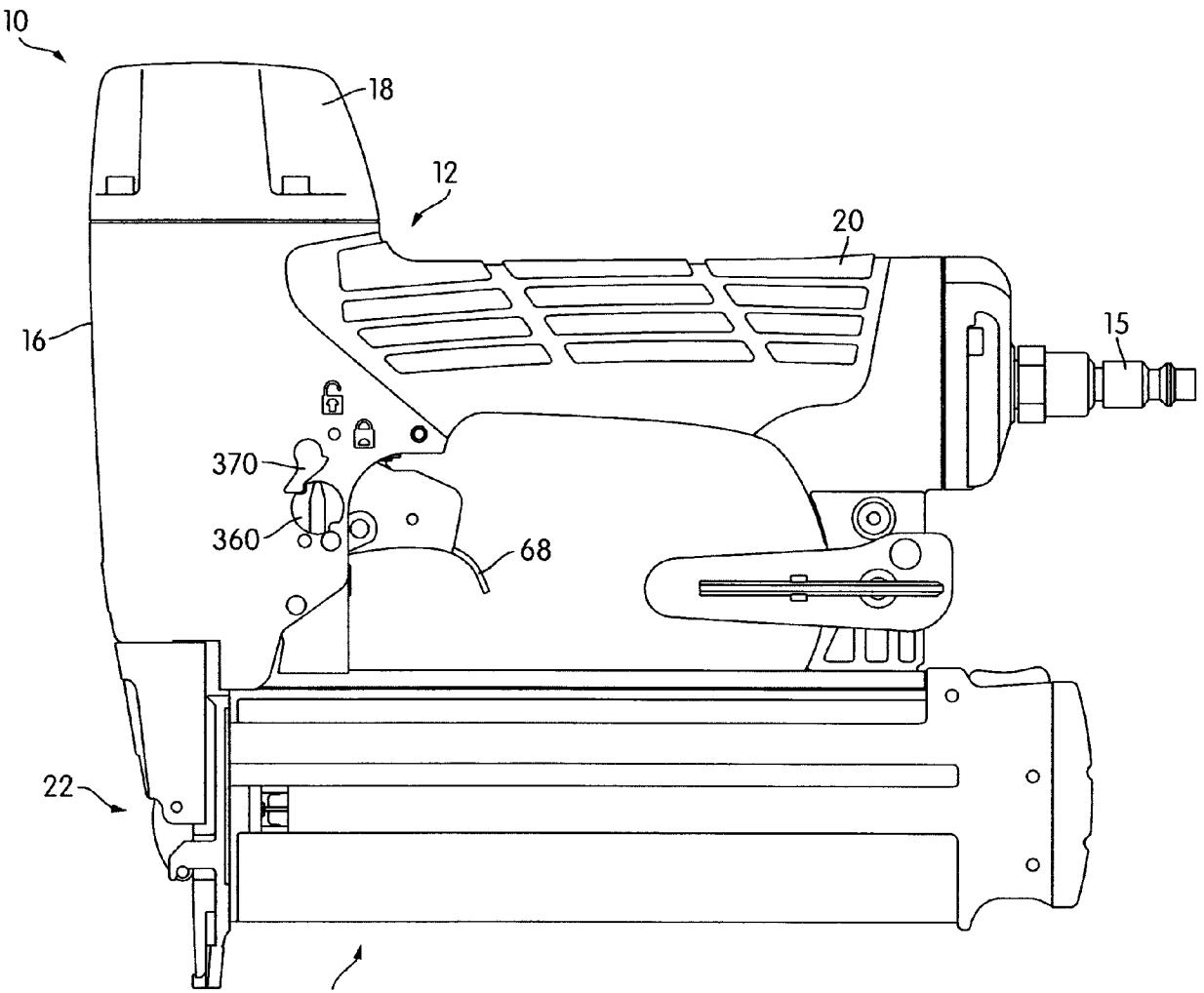
FIG. 1 illustrates a fastening tool in accordance with an embodiment of the present invention.
Figure 2:
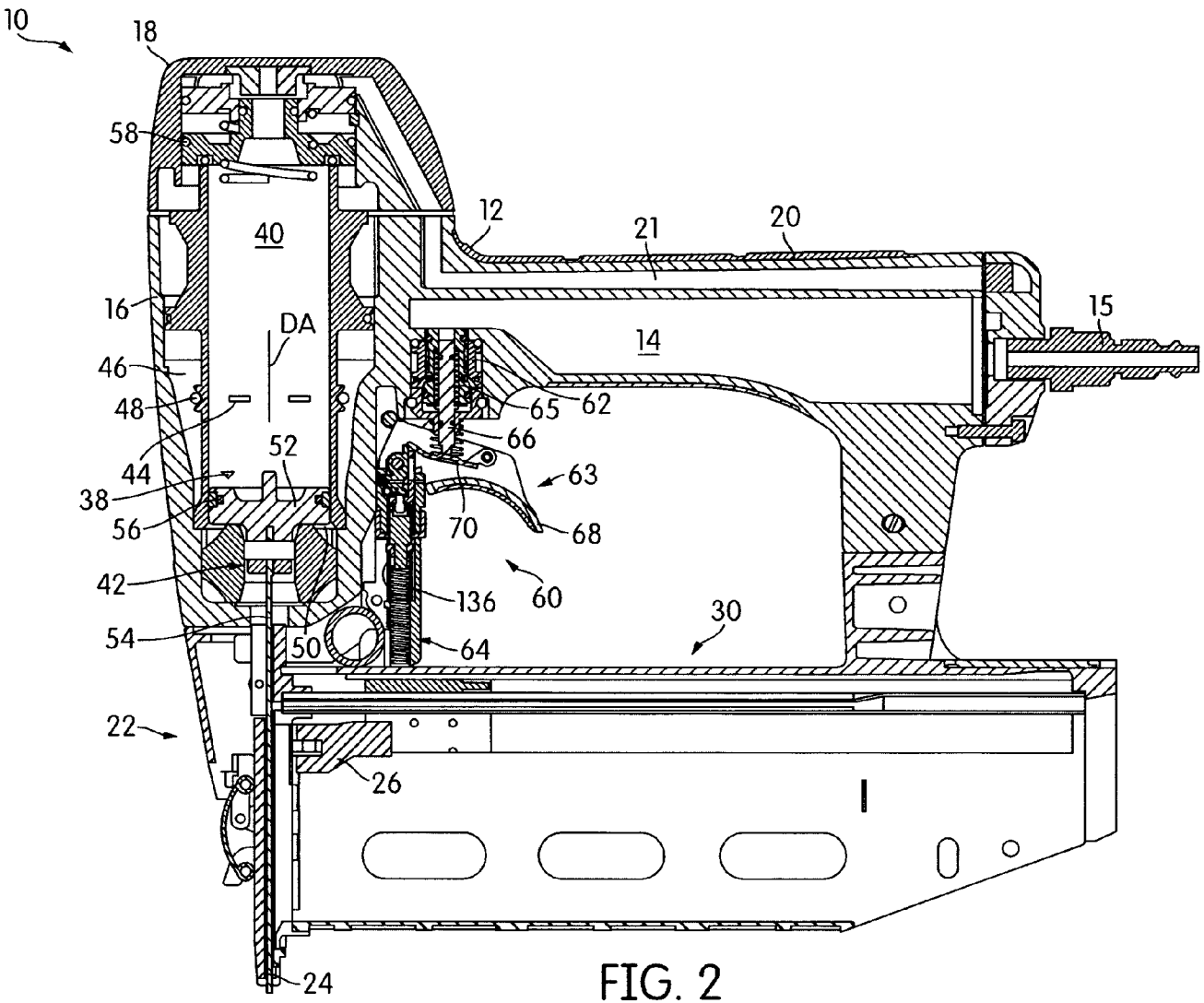
FIG. 2 illustrates a cross-section of a fastening tool in accordance with an embodiment of the invention.

FIGS. 1 and 2 illustrate a fastening tool 10 according to an embodiment of the invention. The tool 10 includes a housing 12 that defines a reservoir 14 therein. The housing 12 may be constructed from a lightweight yet durable material, such as magnesium. The reservoir 14 is configured to receive a pressurized gas that is used to power the tool 10. In an embodiment, the pressurized gas may be provided to the reservoir 14 from a compressor through a hose. The hose may be connected to the tool 10 via a fitting 15 that may be attached to the housing 12, or the pressurized gas may be provided to the reservoir 14 through a cartridge. For example, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the tool 10. The illustrated embodiment is not intended to be limiting in any way.

As illustrated, the housing 12 includes an engine receiving portion 16 and a cap 18 that is connected to the engine receiving portion 16 at one end. The housing 12 also includes a handle portion 20 that extends from the engine receiving portion 16. As shown, the handle portion 20 may extend substantially perpendicularly from the engine receiving portion 16. The handle portion 20 is configured to be received by a user's hand, thereby making the tool 10 portable. The reservoir 14 is substantially defined by the handle portion 20, although it is contemplated that a portion of the reservoir 14 may be defined by the engine receiving portion 16 as well. In an embodiment, the handle portion 20 may also include a second reservoir 21 that is configured to be open to atmosphere and is configured to allow exhaust gas to exit the tool 10 through the handle portion 20.

The tool 10 also includes a nose assembly 22 that is connected to the housing 12. The nose assembly 22 defines a fastener drive track 24 therein, as illustrated in FIG. 2. A magazine assembly 30 is constructed and arranged to feed successive leading fasteners from a supply of fasteners contained therein along a feed track and into the drive track 24. The supply of fasteners is urged toward the drive track 24 with a pusher 26 that is biased towards the drive track 24 and engages the last fastener in the supply of fasteners. Although the illustrated magazine assembly 30 is configured to receive fasteners that are collated in a stick configuration, it is also contemplated that a magazine assembly that is configured to accommodate fasteners that are collated in a coil may also be used. The illustrated embodiment is not intended to be limiting in any way.

As shown in FIG. 2, an engine 38 is disposed in the engine receiving portion 16 of the housing 12. The engine 38 includes a cylinder 40 and a fastener driver 42 that is movably mounted in the cylinder 40, and, hence, the housing 12. The cylinder 40 is oriented such that its longitudinal axis substantially aligns with a longitudinal axis of the drive track 24. The cylinder 40 includes a plurality of openings 44 that are arranged circumferentially around the cylinder 40 at an intermediate portion thereof. The openings 44 allow gas that is in the cylinder 40 to flow into a plenum 46 that is defined by an outside surface of the cylinder 40 and the housing 12. The openings 44 are provided with seals 48 that act as one-way valves such that gas may exit the cylinder 40 into the plenum 46, but gas in the plenum 46 may not enter the cylinder 40 through the openings 44. Instead, gas may enter the cylinder 40 through at least one opening 50 that is located towards one end of the cylinder 40 near the drive track 24, as shown in FIG. 2. Movement of gas in and out of the cylinder 40 will be discussed in greater detail below in connection with the operation of the tool 10.

The fastener driver 42 is configured to enter the drive track 24 and drive the successive leading fasteners, one at a time, into the workpiece. The fastener driver 42 may have any configuration. In the illustrated embodiment, the fastener driver 42 includes a piston 52 and a drive rod 54 that is connected to the piston 52. A seal 56 is provided between the piston 52 and an interior wall of the cylinder 40 so as to form a slidable seal. This allows pressure on one side of the piston 52 to be different from pressure on the other side of the piston 52 so that a pressure differential may effect movement of the piston 52. The drive rod 54, although illustrated as pinned, may be connected to the piston 52 by any suitable fastening technique, such as a threaded or a welded connection. The illustrated embodiment is not intended to be limiting in any way. The drive rod 54 may have a substantially circular cross-section, or the drive rod 54 may have a cross-section that is rectangular shaped, D-shaped, or is shaped as a crescent, as would be understood by one of ordinary skill in the art.

The engine 38 also includes a head valve 58, shown in FIG. 2 that is disposed above the cylinder 40. The head valve 58 is constructed and arranged to substantially seal the top of the cylinder 40 from the reservoir 14 when the head valve 58 is in a closed position, and move away from the cylinder 40 when the head valve 58 is moved to an open position. A head valve spring (not shown) is disposed between the head valve 58 and the cap 18 such that the head valve 58 is biased to the closed position when there is no pressurized gas in the tool 10 or when the pressurized gas applies equal force on both sides of the head valve 58. The head valve 58 is constructed and arranged to be actuated so as to allow the pressurized gas that is in the reservoir 14 to enter the cylinder 40 and move the fastener driver 42 through an operating cycle. Each cycle includes a drive stroke in which the driver 42 moves along a drive axis DA and drives the leading fastener into the workpiece, and a return stroke in which the driver 42 is returned to its initial position so that it is ready for another drive stroke.

The tool 10 also includes an actuation device or actuator 60 that is constructed and arranged to actuate the head valve 58, and, hence, initiate the drive stroke. The actuator 60 includes a trigger valve 62, a trigger assembly 63, and a contact arm assembly 64 that interacts with the trigger valve 62 via the trigger valve assembly 63, as discussed in further detail below. The trigger valve 62 is constructed and arranged to allow passage of the pressurized gas from the reservoir 14 to a chamber above the head valve 58 through a passageway (not shown), and to selectively allow passage of gas from the chamber through an exhaust opening in the trigger valve 62.

The trigger valve 62 may be moved to the actuated position by pressing a valve stem 66 against the force applied on the valve stem 66 by the pressurized gas, and the bias of a valve spring 65 that is disposed within the trigger valve 62. This may be done with the user's finger, or can be done with a trigger 68 having a trigger arm 70 disposed therein. In at least one embodiment of the present invention, the trigger 68 is rotatably mounted to the housing 12. In an embodiment of the present invention, the trigger 68 may be linearly mounted so that the trigger 68 has linear movement rather then rotational movement, as discussed in further detail below. When the trigger 68 is moved toward the valve stem 66 while the contact arm assembly 64 is in contact with the workpiece, the trigger 68 engages the valve stem 66 and presses the valve stem 66 against the bias of the valve spring 65 in the trigger valve 62. When the trigger valve 62 is actuated, i.e. when the valve stem 66 is moved against the bias of the valve spring 65 in the trigger valve 62, the passageway within the trigger valve 62 between the chamber above the head valve 58 and the exhaust opening is opened, and the pressurized gas in the chamber is now able to flow through the trigger valve 62 and out the exhaust opening. Various embodiments of the actuation device 60 in accordance with the present invention are discussed in further detail below.

Actuation of the head valve 58, or movement of the head valve 58 to the open position, will depend on whether the pressurized gas from the chamber above the head valve 58 is exhausted to atmosphere through the trigger valve 62. Once the pressurized gas from the chamber starts to be exhausted, the pressure within the chamber drops. This pressure drop, when high enough, allows the head valve 58 to move to the open position due to the force being exerted on the head valve 58 by the pressurized gas within the reservoir 14, which is at a greater pressure. Additional details of suitable engines and actuators for the fastening tool 10 may be found in, for example, U.S. Pat. Nos. 7,134,586, 7,143,918, and 7,677,426, the entire contents which are incorporated herein by reference.

The tool 10 may also include a depth adjusting assembly as part of the contact arm assembly 64. In general, the depth adjusting assembly can be employed to control the depth at which a fastener is driven into a workpiece (i.e., to a depth that could be raised above, flush with or below the surface of the workpiece). In this way, the depth adjusting assembly cooperates with the contact arm assembly so as to permit the tool operator to vary the depth at which the tool 10 sets the fasteners.

FIGS. 5-10 illustrate an actuation device 100 in accordance with an embodiment of the tool 10 that is configured to operate in sequential mode. The actuation device 100 includes a sequential trigger assembly 110, a contact trip assembly 130, and a movable nose 150 (illustrated in FIGS. 3 and 4) operatively connected to the contact trip assembly 130.

Figure 5:
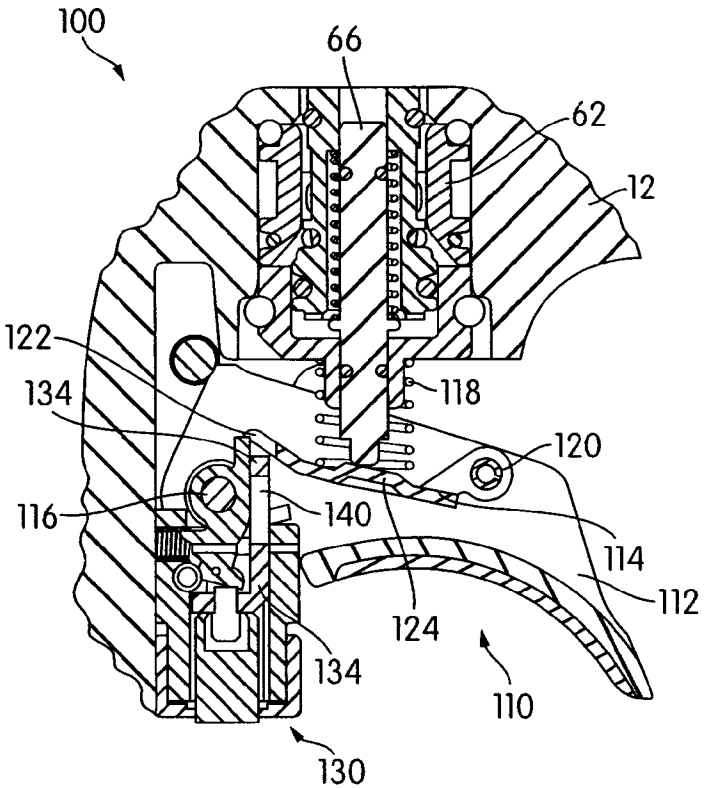
FIG. 5 illustrates a trigger assembly and a portion of a contact trip assembly of the fastening tool of FIG. 2 in accordance with an embodiment of the invention.

As illustrated in FIG. 5, the trigger assembly 110 includes a trigger 112 that is supported by the housing 12, a trigger arm or rocker 114 that is supported by the trigger 112, and a check pawl 116. The trigger arm 114 is constructed and arranged to interact with the valve stem 66 of the trigger valve 62, as well as the contact trip assembly 130. A trigger spring 118 is positioned between the portion of the housing 12 that supports the trigger valve 62 and the trigger arm 114, and is configured to bias the trigger arm 114 and the trigger 112 away from the trigger valve 62. A proximal end 120 of the trigger arm 114 is pivotally connected to the trigger 112, and a distal end 122 of the trigger arm 114 rests on top of the contact trip assembly 130. A center portion 124 of the trigger arm 114 that is in between the proximal end 120 and the distal end 122 is configured to press against the valve stem 66 of the trigger valve 62.

Figure 4:
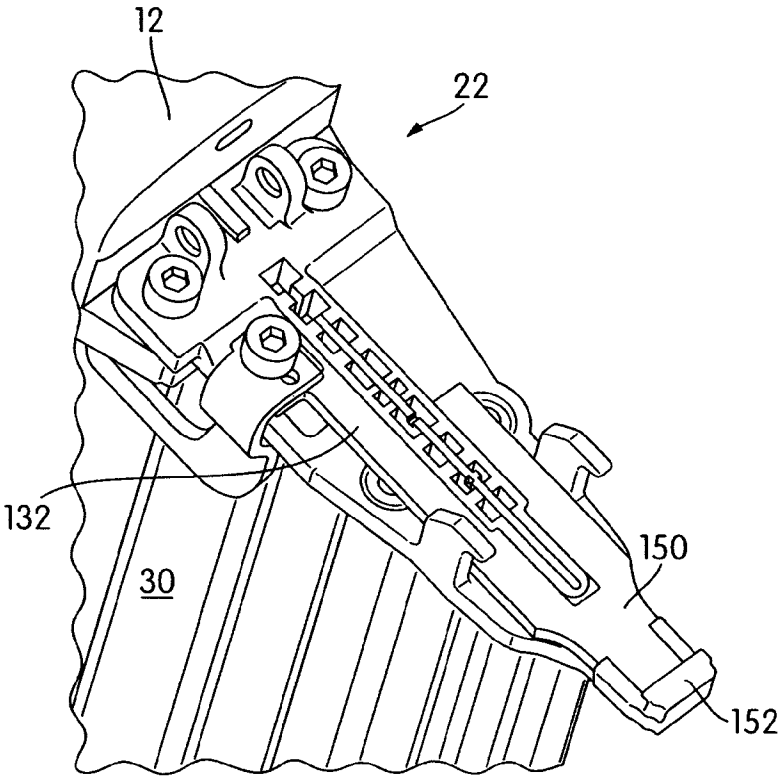
FIG. 4 illustrates a portion of a nose assembly and a contact trip assembly with integrated movable nose portion of the fastening tool in accordance with an embodiment of the invention.
Figure 3:
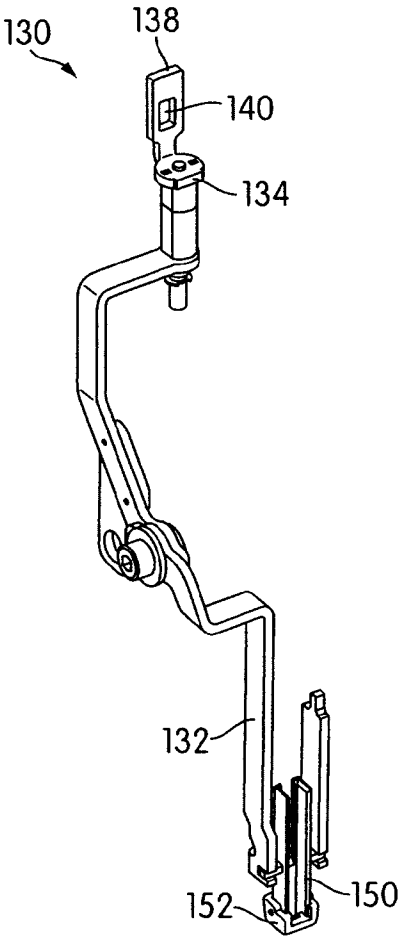
FIG. 3 illustrates a contact trip assembly and movable nose portion of the fastening tool of FIG. 2 in accordance with an embodiment of the invention.

The contact trip assembly 130 includes a lower contact arm 132 that is connected to the movable nose 150, as shown in FIG. 3, and an upper contact arm 134 that is operatively connected to the lower contact arm 132. The lower contact arm 132 may be integrated into the movable nose 150, as illustrated in FIG. 4, which has a smaller footprint than a typical nose, which may provide increased visibility to the operator. The movable nose 150 may have a no mar tip 152, which is configured to be placed on a workpiece, at a distal end of the movable nose 150.

A contact arm spring 136 (illustrated in FIG. 2) is configured to bias the upper contact arm 134, the lower contact arm 132, and the movable nose 150 upward, so that the lower contact arm 132 and the movable nose 150 do not extend away from the rest of the nose assembly 22 of the tool 10. The biasing of the lower contact arm 132 and the movable nose 150 upward provides improved visibility for placing the next fastener to be driven by the tool 10 more precisely and more easily than tools with a traditional contact arm that normally extends outward and away from the nose assembly, and also minimizes or eliminates any stroke when the tool 10 is placed onto a workpiece. In other words, the tool 10 does not need to be pressed against the workpiece with force in order to move the lower contact arm into an operative position to actuate the tool 10. Instead, the tool 10 is merely positioned on the workpiece in order to actuate the tool 10, as discussed in further detail below.

As illustrated in FIG. 5, the upper contact arm 134 has a free end 138 upon which the distal end 122 of the trigger arm 114 rests. The upper contact arm 134 also has an opening 140 that is spaced from the free end 138. The opening 140 may define a window that is void of material. In an embodiment, the opening may be a recess in the upper contact arm 134 that is configured to engage the check pawl 116.

FIG. 5 illustrates a portion of the actuation device 100 after the tool 10 has been positioned so that the movable nose 150 is in contact with the workpiece and biased upward. As illustrated, the trigger 112 is biased in the down position, away from the trigger valve 62, i.e., the rest position, and the check pawl 116 is not engaged with the opening 140 of the upper contact arm 134. The tool 10 is not actuated.

Figure 6:
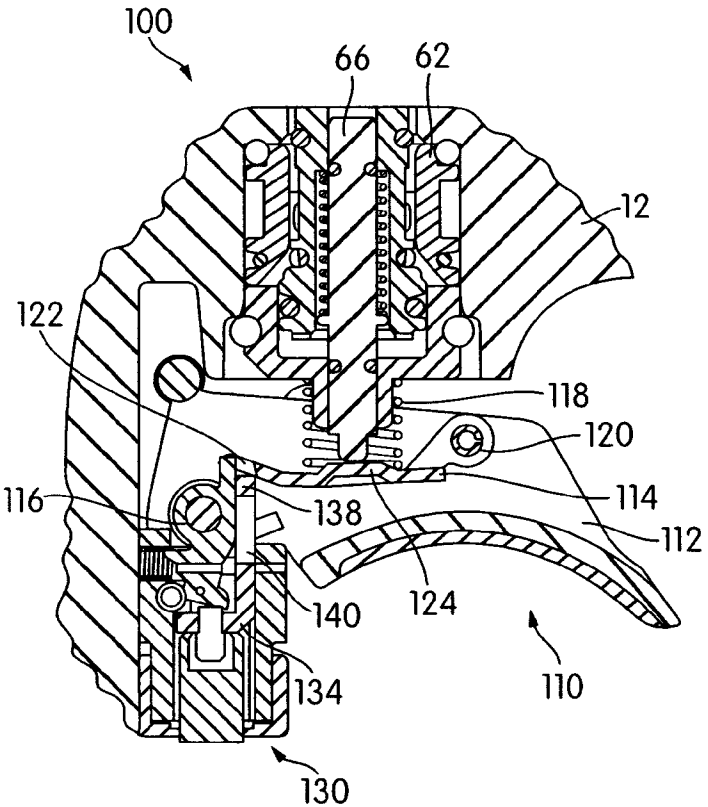
FIG. 6 illustrates the trigger assembly and the portion of the contact trip assembly of FIG. 5 with a trigger of the trigger assembly moved upward and a movable nose portion of the fastening tool in contact with a workpiece.
Figure 7:
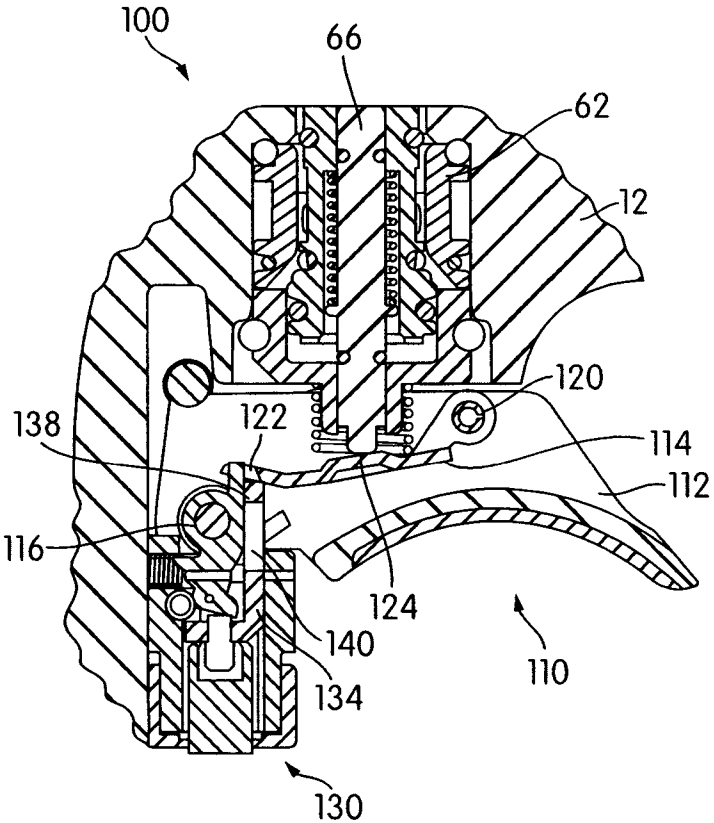
FIG. 7 illustrates the trigger assembly and the portion of the contact trip assembly of FIG. 6 with the trigger moved further upward.

FIG. 6 illustrates the tool 10 in the same condition as FIG. 5, with the exception of the trigger 112 being moved upward and towards the trigger valve 62 and the trigger arm 114 pressing the valve stem 66 inward in an attempt to actuate the tool 10. FIG. 7 illustrates the tool 10 in the same condition as FIG. 6, with the exception of the trigger 112 being moved all the way upward and towards the trigger valve 62 and the trigger arm 114 pressing the valve stem 66 inward to actuate the tool 10. Because the movable nose 150 is still in contact with the workpiece, the lower contact arm 132 and the upper contact arm 134 are in the upmost position and do not move even though the distal end 122 of the trigger arm 114 is pressing against the free end 138 of the upper contact arm 134.

Figure 8:
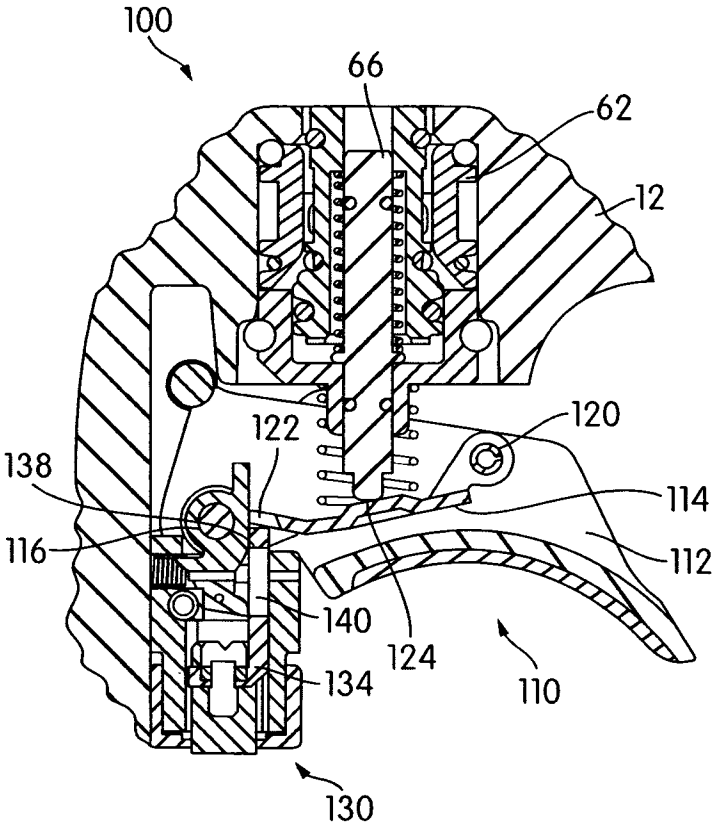
FIG. 8 illustrates the trigger assembly and the portion of the contact trip assembly of FIG. 5 with the trigger moved upward and the movable nose portion of the fastening tool not in contact with a workpiece.

FIG. 8 illustrates a portion of the actuation device 100 when the movable nose 150 is not in contact with the workpiece, and the trigger 112 has been moved upward and towards the trigger valve 62. Because the movable nose 150 is not in contact with the workpiece, the force applied to the free end 138 of the upper contact arm 134 causes the upper contact arm 134, the lower contact arm 132, and the movable nose 150 to move downward against the bias of the contact arm spring 136.

Figure 9:
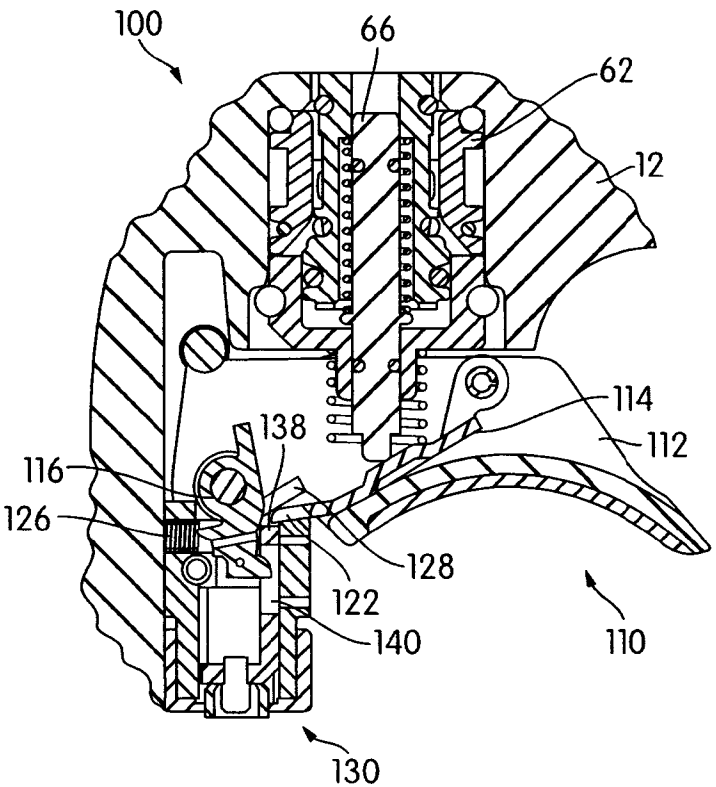
FIG. 9 illustrates the trigger assembly and the portion of the contact trip assembly of FIG. 8 with the trigger moved further upward and a check pawl moved into engagement with an upper contact arm of the contact trip assembly.

FIG. 9 illustrates the tool 10 in the same condition as FIG. 8 with the exception of the trigger 112 having been moved all the way upward and towards the trigger valve 62 and, correspondingly, the upper contact arm 134 having been moved even further downward. As illustrated, when the upper contact arm 134 is in this down position, the check pawl 116 becomes aligned with the opening 140 in the upper contact arm 134 and is biased by a check pawl spring 126 towards the opening 140 so that the check pawl 116 engages the upper contact arm 134, thereby locking the contact trip assembly 130 in an extended position with respect to the housing 12 of the tool 10. Because of the orientation of the trigger arm 114 relative to the valve stem 66, the trigger arm 114 does not press the valve stem 66 inward to the degree that will cause the trigger valve 62 to actuate the tool 10. In addition, because the check pawl 116 is engaged with the upper contact arm 134 so that the contact trip assembly 130 and the movable nose 150 are locked in the down position, the tool 10 will not actuate even if the operator tries to actuate the tool 10 by contact trip actuation.

Figure 10:
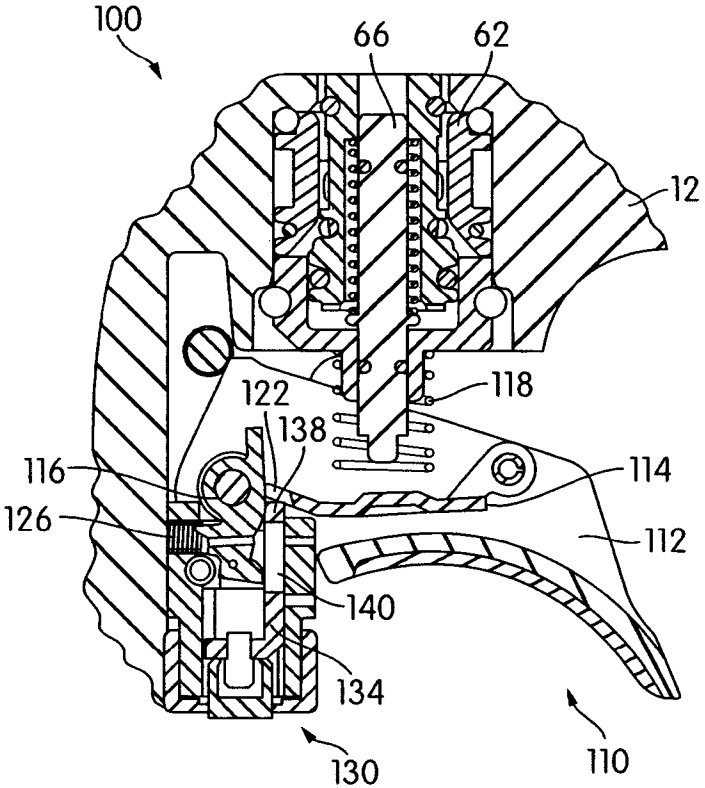
FIG. 10 illustrates the trigger assembly and the portion of the contact trip assembly of FIG. 9 after the trigger has been release and a protrusion on the trigger has moved the check pawl out of engagement with the upper contact arm of the contact trip assembly.

FIG. 10 illustrates the tool 10 in the same condition as FIG. 9, with the exception that the trigger 112 has been released. The trigger spring 118 biases the trigger 112 downward, and a protrusion 128 (shown in FIG. 9), which may be in the form of a pad that has been attached to the trigger 112 or integrally formed in the trigger 112, engages the check pawl 116 and pushes the check pawl 116 against the bias of the check pawl spring 126 out of the opening 140 of the upper contact arm 134. The trigger spring 118 is configured to have enough force to rotate the trigger 112 downward and push the check pawl 116 out of the opening 140 of the upper contact arm 134. With the check pawl 116 out of the opening 140, the check pawl spring 136 biases the upper contact arm 134 upward to the position illustrated in FIG. 5. The tool 10 is once again at rest and ready for the next actuation in the sequential mode.

FIGS. 11-14 illustrate an actuation device 300 of the tool 10 according to an embodiment of the present invention. The actuation device 300 includes a trigger assembly 310, and the contact trip assembly 130 and the movable nose 150 described above with respect to FIGS. 2-8.

The trigger assembly 310 includes a sliding trigger 312 that is supported by a trigger guide 314 that may be connected to or otherwise supported by the magazine assembly 30, and a trigger arm or rocker 316 that is supported by the trigger 312, and a check pawl 318. The check pawl 318 may be of a similar design as the check pawl 116 described above. The trigger arm 316 is constructed and arranged to interact with the valve stem 66 of the trigger valve 62, as well as the contact trip assembly 130. A trigger spring (not shown in FIGS. 11-14), which may be similar to the trigger spring 118 illustrated in FIGS. 5-10, is positioned between the portion of the housing 12 that supports the trigger valve 62 and the trigger arm 316, and is configured to bias the trigger arm 316 and the trigger 312 away from the trigger valve 62. In the embodiment illustrated in FIGS. 11-14, a proximal end 322 of the trigger arm 316 is pivotally connected to the trigger 312, and a distal end 324 of the trigger arm 316 rests on top of the contact trip assembly 130. A center portion 326 of the trigger arm 316 that is in between the proximal end 322 and the distal end 324 is configured to press against the valve stem 66 of the trigger valve 62.

The sliding trigger 312 and the trigger guide 314 have corresponding slideway surfaces 312*a*, 314*a* that are configured to allow the sliding trigger 312 to slide smoothly along the slideway surfaces 314*a* of the trigger guide 314 upward towards the trigger valve 62 and downward, away from the trigger valve 62 and towards the magazine assembly 30. In contrast to the trigger 112 discussed above, movement of the sliding trigger 312 is linear instead of rotational.

Figure 12:
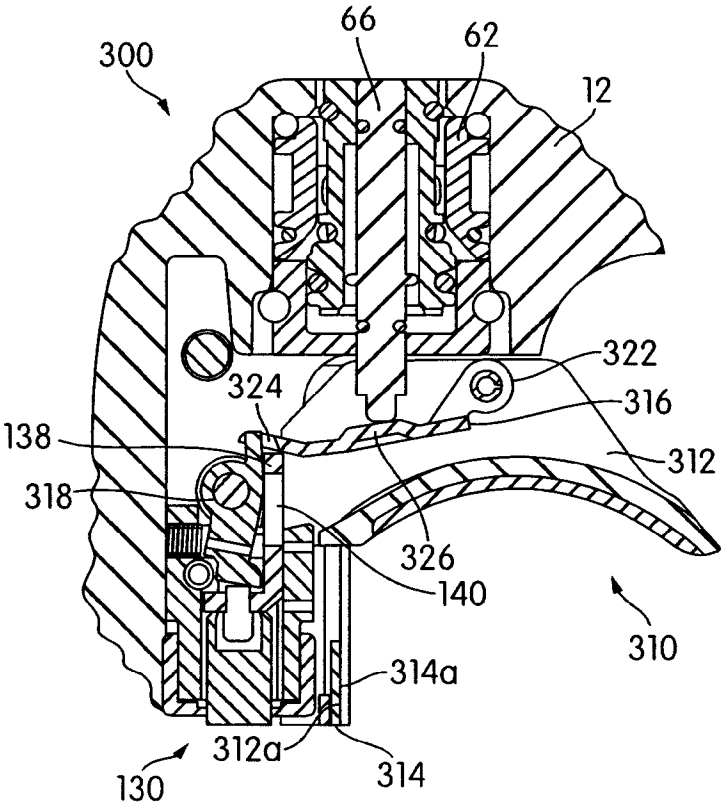
FIG. 12 illustrates the trigger assembly and the portion of the contact trip assembly of FIG. 11 with a sliding trigger of the trigger assembly moved upward and the movable nose portion of the fastening tool in contact with a workpiece.
Figure 11:
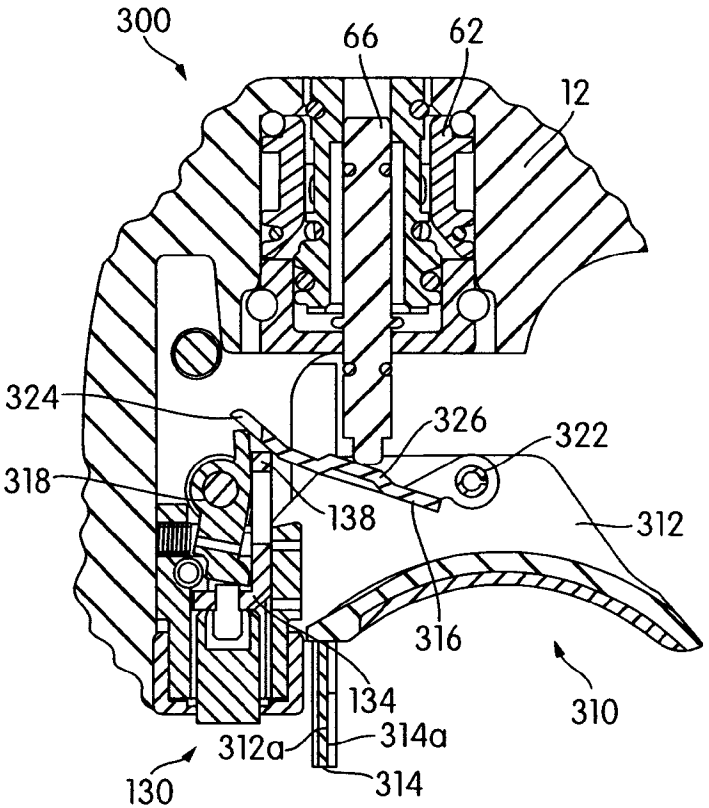
FIG. 11 illustrates the trigger assembly and a portion of the contact trip assembly of the fastening tool in accordance with an embodiment of the invention.

FIG. 11 illustrates a portion of the actuation device 300 with the trigger 312 in a down or at rest position. FIG. 12 illustrates the tool 10 with the movable nose 150 in contact with a workpiece and the trigger 312 in the upmost position, which causes the center portion 326 of the trigger arm 316 to press the valve stem 66 upward to a position that actuates the trigger valve 62 and the engine 38 of the tool to drive a fastener into the workpiece.

Figure 13:
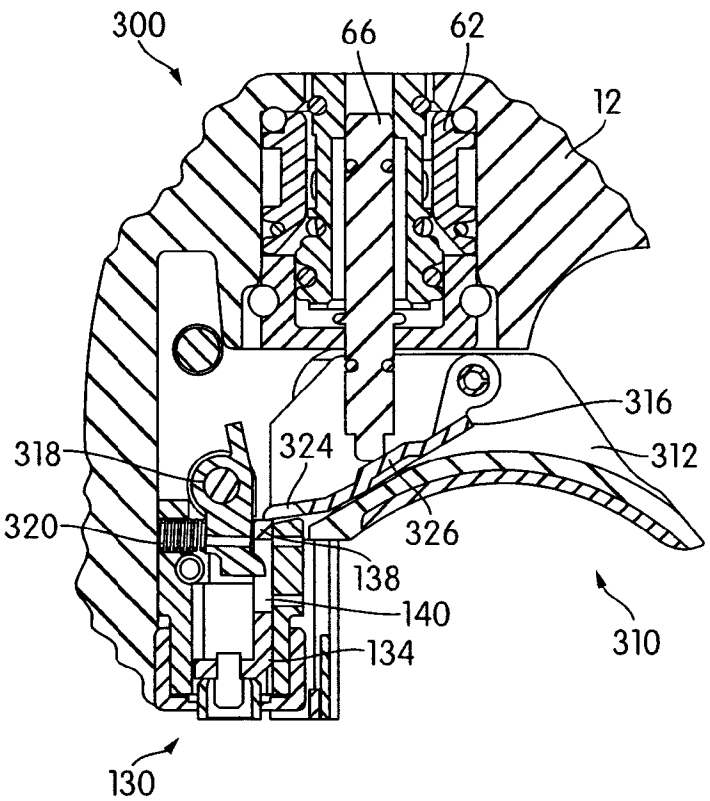
FIG. 13 illustrates the trigger assembly and the portion of the contact trip assembly of FIG. 11 with the sliding trigger moved upward and the movable nose portion of the fastening tool not in contact with a workpiece and the check pawl moved into engagement with the upper contact arm of the contact trip assembly.

FIG. 13 illustrates the tool 10 when the movable nose 150 is not in contact with the workpiece and the trigger 312 is in the upmost position, which causes the contact trip assembly 130 and the movable nose 150 to move downward. In this condition, the check pawl 318 is biased into the opening 140 of the upper contact arm 134 by a check pawl spring 320, which prevents the contact trip assembly 130 from moving upward enough to cause the center portion 326 of the trigger arm 316 to press the valve stem 66 inward enough to cause the trigger valve 62 to actuate.

Figure 15:
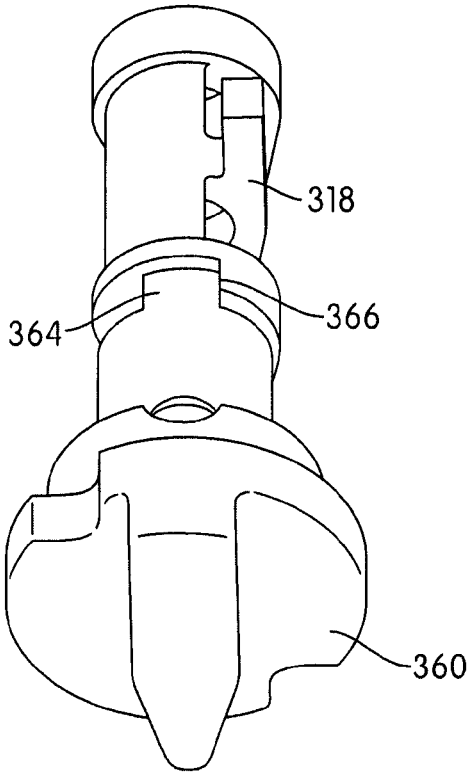
FIG. 15 illustrates an embodiment of the mode selector and the check pawl of the fastening tool in accordance with an embodiment of the invention.

In an embodiment, the check pawl 318 may be positionable by a mode selector 360, which is illustrated in FIGS. 1 and 15. The mode selector 360 is configured to be a knob rotatable between a sequential mode position and a contact trip mode position. Aspects of the mode selector 360 and corresponding trigger lock 370 (illustrated in FIG. 1) are discussed in U.S. patent application Ser. No. 12/504,117, filed Jul. 16, 2009, which published as United States Patent Application Publication No. 2010/0012700 on Jan. 21, 2011, the content of which is incorporated herein in its entirety.

As illustrated in FIG. 15, the mode selector 360 includes a protrusion 364 that is configured to engage surfaces 366 on the check pawl 318 such that rotation of the mode selector 360 rotates the check pawl 318. FIG. 13 illustrates a condition in which the mode selector 360 is positioned in sequential mode, which allows the check pawl 318 to enter the window 140 and engage the upper contact arm 134, and prevents the trigger valve 62 from being actuated, even if the operator presses the movable nose 150 against the workpiece.

Figure 14:
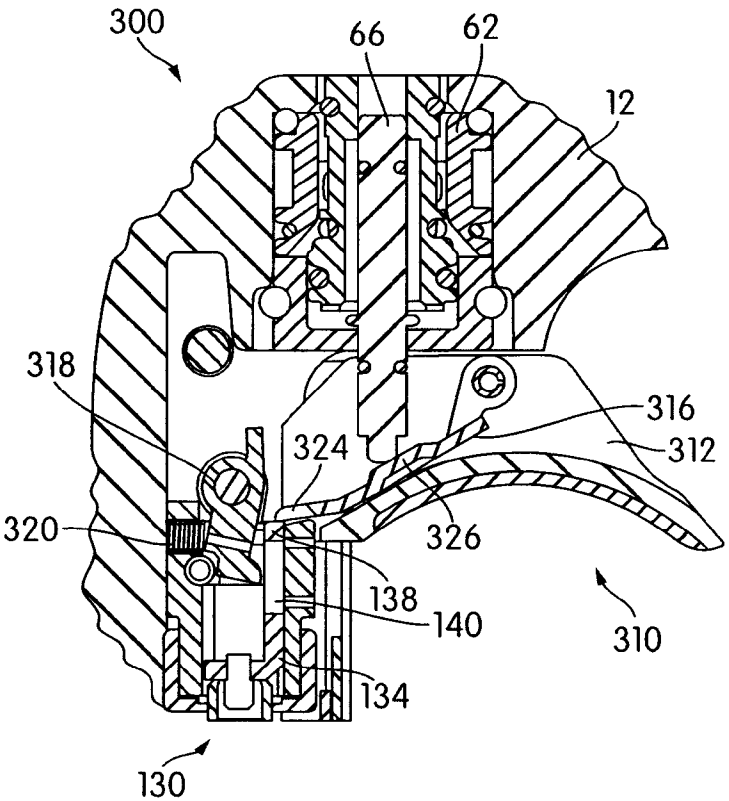
FIG. 14 illustrates the trigger assembly and the portion of the contact trip assembly of FIG. 11 with the sliding trigger moved upward and the movable nose portion of the fastening tool not in contact with a workpiece and a mode selector in a contact trip mode position that prevents the check pawl from moving into engagement with the upper contact arm of the contact trip assembly.

FIG. 14 illustrates when the mode selector 360 is positioned in contact trip mode. Rotation of the mode selector 360 into contact trip mode causes the check pawl 318 to be locked in the position illustrated in FIG. 14, which prevents the check pawl 318 entering the window 140 of the upper contact arm 134. In this condition, the movable nose 150 is extended outward and away from the housing 12 of the tool 10. If the operator presses the movable nose 150 against the workpiece with the tool 10 in this condition, the movable nose 150 and the contact trip assembly 130 will move upward, and the upper contact arm 134 will move the distal end 324 of the trigger arm 316 upward, which will allow the center portion 326 of the trigger arm 316 to press the valve stem 66 inward to cause actuation of the trigger valve 62 and the engine 38 of the tool 10.

The check pawl 318 may be rotated by the mode selector 360 in a direction toward the upper contact arm 324 to effect operation of the tool 10 in a sequential mode, as shown in FIGS. 11 and 12. In the sequential mode, the check pawl 318 is moved into a second position that allows the check pawl 318 to move within the window 140 in the upper contact arm 134, as described above, which locks the position of the contact arm assembly 130 in a position away from the trigger 312 if the trigger 312 is pulled, i.e. moved upward, when the movable nose 150 is not in contact with the workpiece. This prevents the operator from using the tool in contact trip mode. When the operator releases the trigger 312, the force from the trigger spring forces the trigger 312 linearly downward. A protrusion (not shown) on the trigger 312 contacts the check pawl 318 that is engaged inside of the window 140 contained within the upper contact arm 134. As the protrusion 328 on the trigger 312 pushes the check pawl 318 out of the window 140, the upper contact arm 134 becomes unlocked and the contact arm spring 136 pushes the upper contact arm 134 upward to prepare for the next actuation in the sequential mode.

FIGS. 16-20 illustrate an actuation device 400 for the tool 10 according to an embodiment of the invention. The actuation device 400 includes a trigger assembly 410, and the contact trip assembly 130 and the movable nose 150 discussed above in other embodiments.

The trigger assembly 410 includes a trigger 412 that is supported by the housing 12, a trigger arm or rocker 414 that is supported by the upper contact arm 134, and a check pawl 416. The trigger arm 414 is constructed and arranged to interact with the valve stem 66 of the trigger valve 62. The check pawl 416 is constructed and arranged to interact with the contact trip assembly 430 and the trigger 412, as discussed in further detail below.

Figure 16:
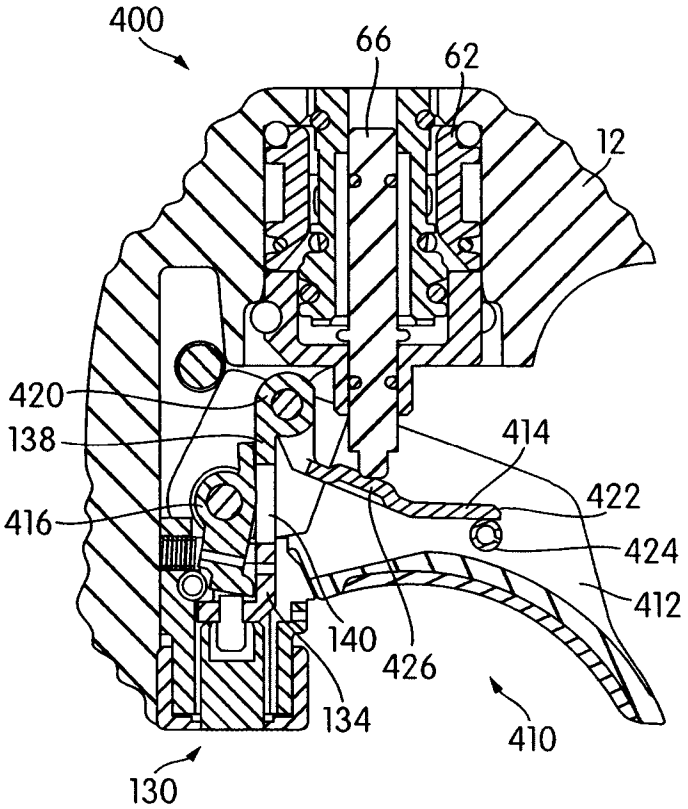
FIG. 16 illustrates the trigger assembly and a portion of the contact trip assembly of the fastening tool in accordance with an embodiment of the invention.

As illustrated in FIG. 16 a proximal end 420 of the trigger arm 414 is pivotally connected to an end 138 of the upper contact arm 134 so that the trigger 412 pivot on the housing 12 and the trigger arm 414 pivot on the upper contact arm 134 are both on the upper contact arm 134 side of the valve stem 66 of the trigger valve 62. A distal end 422 of the trigger arm 414 extends into the trigger 412 and rests on a rod 424 or web that spans across the interior of the trigger 412 between the sides of the trigger 412 so that the distal end 422 of the trigger arm 414 is on a side of the valve stem 66 that is opposite the upper contact arm 134.

Figure 17:
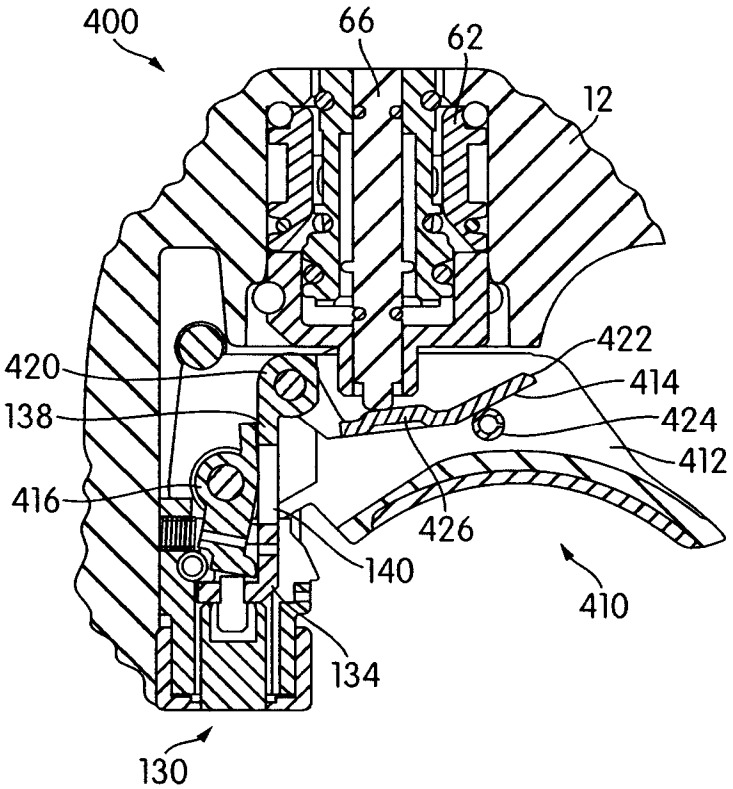
FIG. 17 illustrates the trigger assembly and the portion of the contact trip assembly of FIG. 16 with the trigger moved upward and the movable nose portion in contact with a workpiece.

The mode selector 360 discussed above may be used to allow the operator to select between a contact trip mode and a sequential mode. For example, to operate the tool 10 in sequential mode, the mode selector 360 mode may be rotated to the sequential mode position, which positions the check pawl 416 accordingly. The movable nose 150 is placed in contact with the workpiece and the trigger 412 is rotated upward towards the trigger valve 62. As illustrated in FIG. 17, rotation of the trigger 412 causes a center portion 426 of the trigger arm 414 to press the valve stem 66 inward. Once the trigger 412 has been rotated by a predetermined amount, and as long as the movable nose 150 is still in contact with the workpiece so that the proximal end 420 of the trigger arm 414 remains in an upward position, the valve stem 66 is moved inward enough to cause actuation of the trigger valve 62 and the engine 38 of the tool 10.

Figure 19:
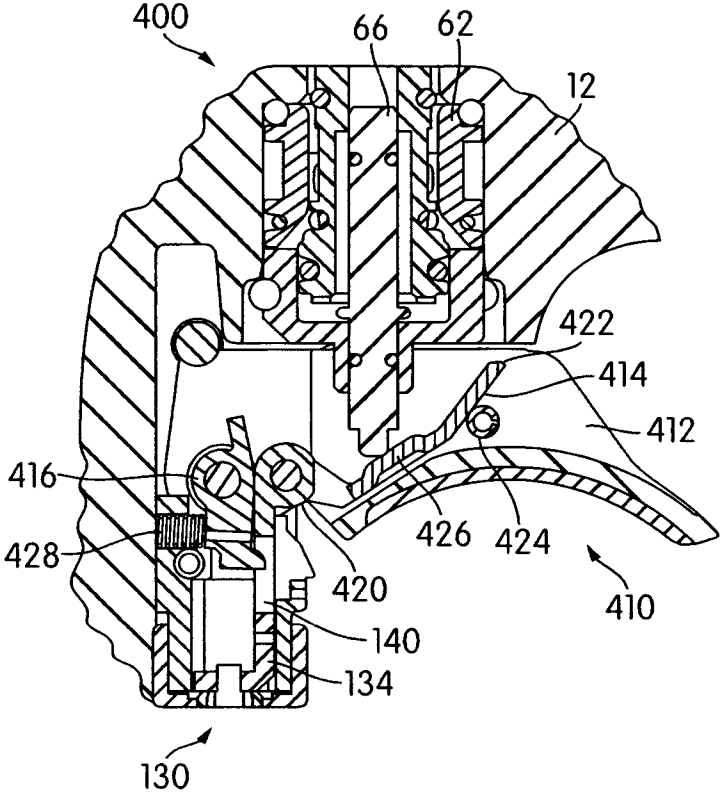
FIG. 19 illustrates the trigger assembly and the portion of the contact trip assembly of FIG. 18 with the trigger moved further upward and upper contact arm moved further downward.
Figure 18:
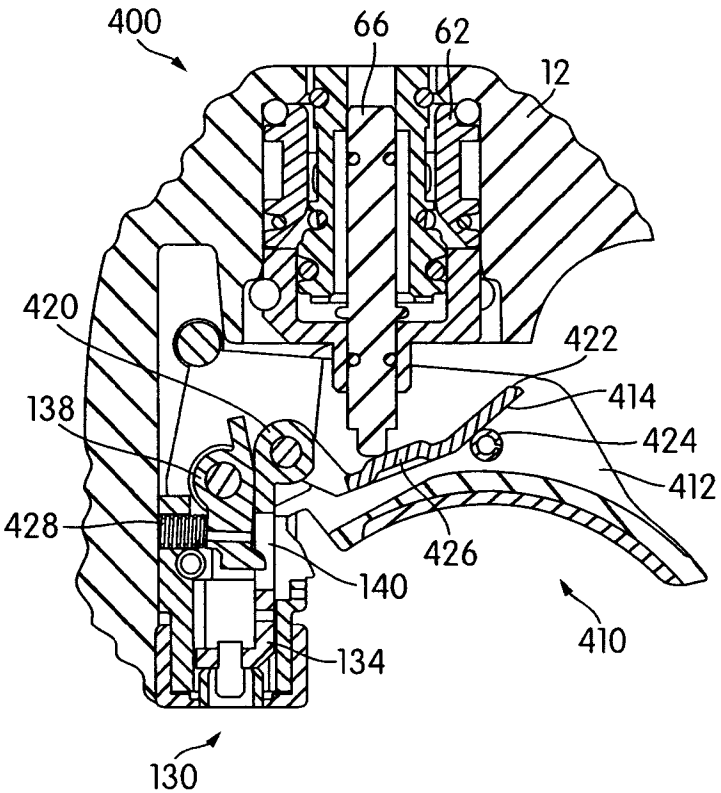
FIG. 18 illustrates the trigger assembly and the portion of the contact trip assembly of FIG. 16 with the trigger moved upward and the movable nose portion not in contact with a workpiece and the check pawl moved into engagement with the upper contact arm of the contact trip assembly.
Figure 20:
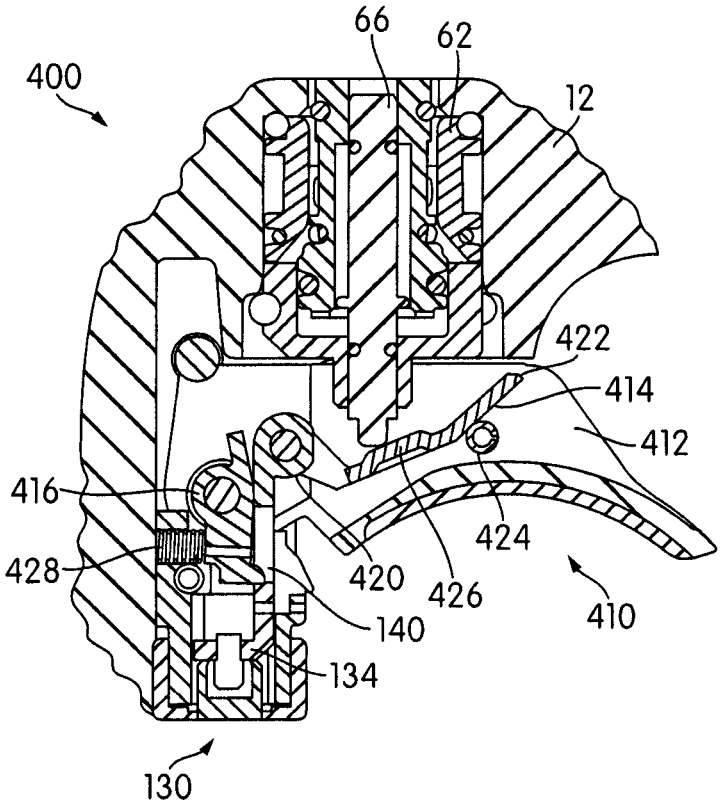
FIG. 20 illustrates the trigger assembly and the portion of the contact trip assembly of FIG. 19 with the moveable nose portion pressed against the workpiece.

FIGS. 18 and 19 illustrate the situation where the mode selector 360 is in the sequential mode position, but the movable nose 150 is not in contact with workpiece. As the trigger 412 is rotated, the upper contact arm 134 is forced downward via the forces acting on the trigger arm 414 by the leverage created by the rod 424 on the trigger arm 414. When the upper contact arm 134 moves to a position in which the opening 140 is aligned with the check pawl 416, the check pawl is biased by a check pawl spring 428 into the opening 140 and locks the upper contact arm 134 and the rest of the contact trip assembly 130 in place. If the movable nose 150 is now pressed against the workpiece, the tool 10 will not actuate, because the contact trip assembly 130 is only able to move upward to the position illustrated in FIG. 20, which does not reposition the proximal end 420 of the trigger arm 414 to allow the center portion 426 of the trigger arm 414 to press the valve stem 66 inward to a position that allows the tool to actuate.

The mode selector 360 may be moved to the contact trip mode position so that the tool 10 may operate in contact trip mode, as described above with respect to the embodiment illustrated in FIG. 14.

Figure 22:
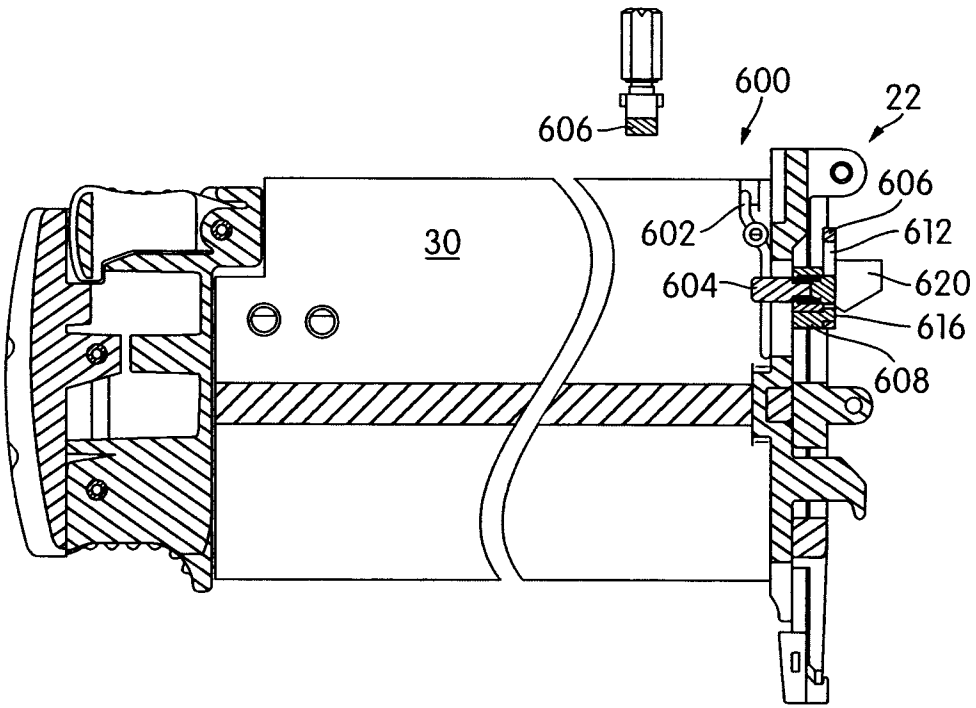
FIG. 22 illustrates a cross-sectional view taken along line 22-22 in FIG. 21.
Figure 21:
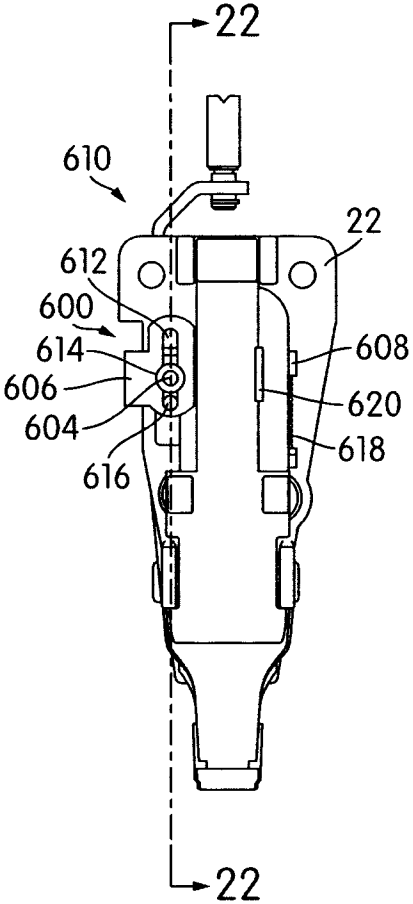
FIG. 21 illustrates a portion of the nose assembly, the contact trip assembly, and a dry fire lockout in accordance with an embodiment of the invention.

FIGS. 21-27 illustrate and embodiment of a dry fire lockout device 600 that may be used with any of the embodiments of the actuation device discussed above. As illustrated in FIG. 22, the dry fire lockout device 600 includes a lever 602 that is pivotally mounted in the magazine assembly 30 near the nose assembly 22. The lever 602 is connected to a pin 604 that connects an upper contact arm 606 and a lower contact arm 608 of a contact trip assembly 610. The upper contact arm 606 includes a slot 612 that has an enlarged circular opening 614 that is configured to receive the pin 604 when the pin 604 is in the engaged position, as illustrated in FIG. 21. The slot 612 is also configured to receive a protrusion 616 located on the lower contact arm 608.

Figure 24:
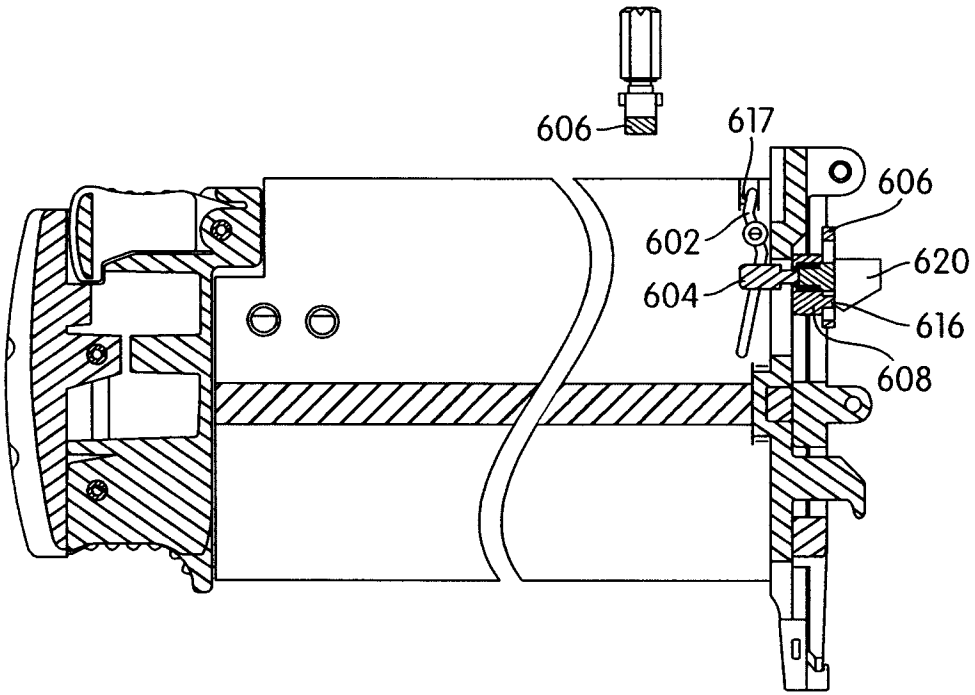
FIG. 24 illustrates a cross-sectional view taken along line 24-24 in FIG. 23.
Figure 23:
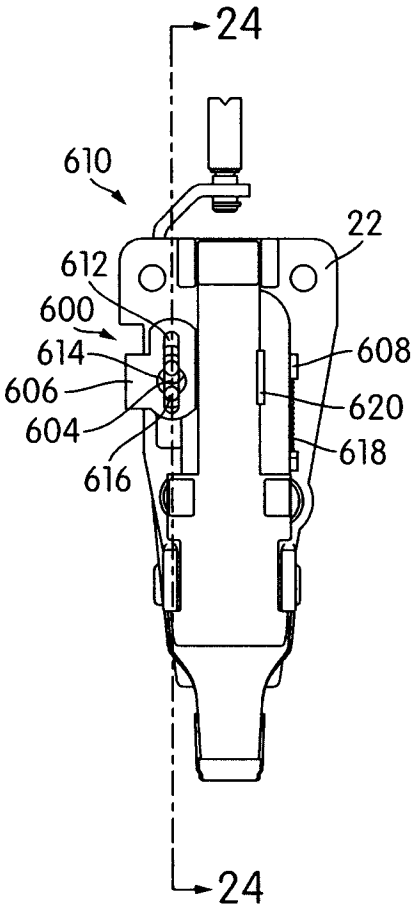
FIG. 23 illustrates the portion of the nose assembly, the contact trip assembly, and the dry fire lockout of FIG. 21 after the dry fire lockout has been actuated.

In this embodiment, the pusher 26 includes a pusher protrusion 617, illustrated in FIG. 24, which is configured to engage and move the lever 602 from a first position, illustrated in FIG. 22 to a second position, illustrated in FIG. 24, when the last fastener is driven by the tool 10. Movement of the lever 602 from the first position to the second position pulls the pin 604 out of the enlarged circular opening 614 in the upper contact arm 606 to disengage the upper contact arm 606 from the lower contact arm 608, as illustrated in FIGS. 23 and 24. A contact arm spring 618 positioned between the lower contact arm 608 and the nose assembly 22 is configured to bias the lower contact arm 608 upward, even when the lower contact arm 608 is decoupled from the upper contact arm 606.

When the dry fire lockout device 600 has been deployed because there are no fasteners left in the magazine assembly 30, if the nose assembly 22 is in contact with the workpiece and the trigger is pulled by the operator, the trigger arm within the trigger will press the upper contact arm 606 downward due to the fact that the upper contact arm 606 has been disengaged from the lower contact arm 608 and therefore may move independently. Movement of the upper contact arm 606 prevents the trigger arm from pressing the valve stem 66 inwardly enough to cause actuation of the trigger valve 62. Therefore, the tool 10 will not actuate when there are no fasteners in the magazine assembly 30.

Figure 26:
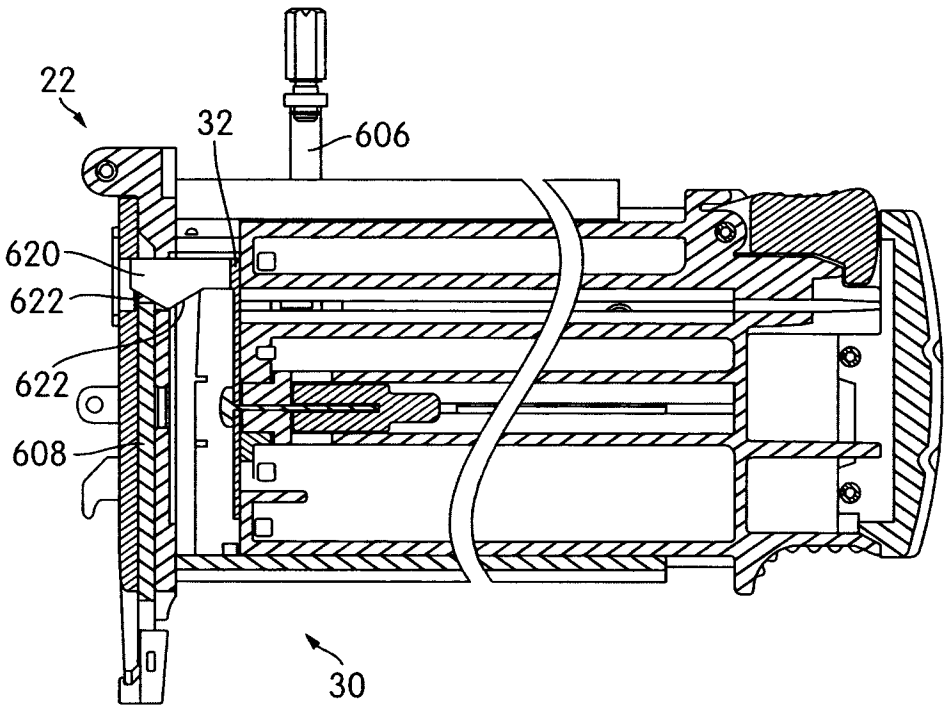
FIG. 26 illustrates a cross-sectional view taken along line 26-26 in FIG. 25.
Figure 25:
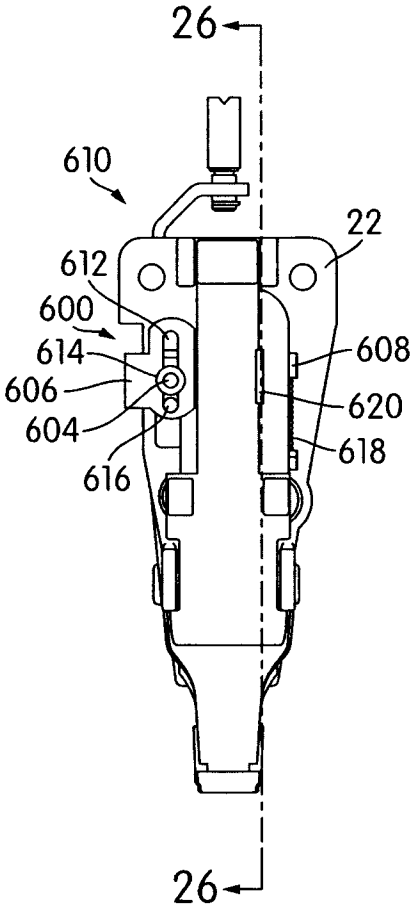
FIG. 25 illustrates the portion of the nose assembly, the contact trip assembly, and the dry fire lockout of FIG. 21.
Figure 27:
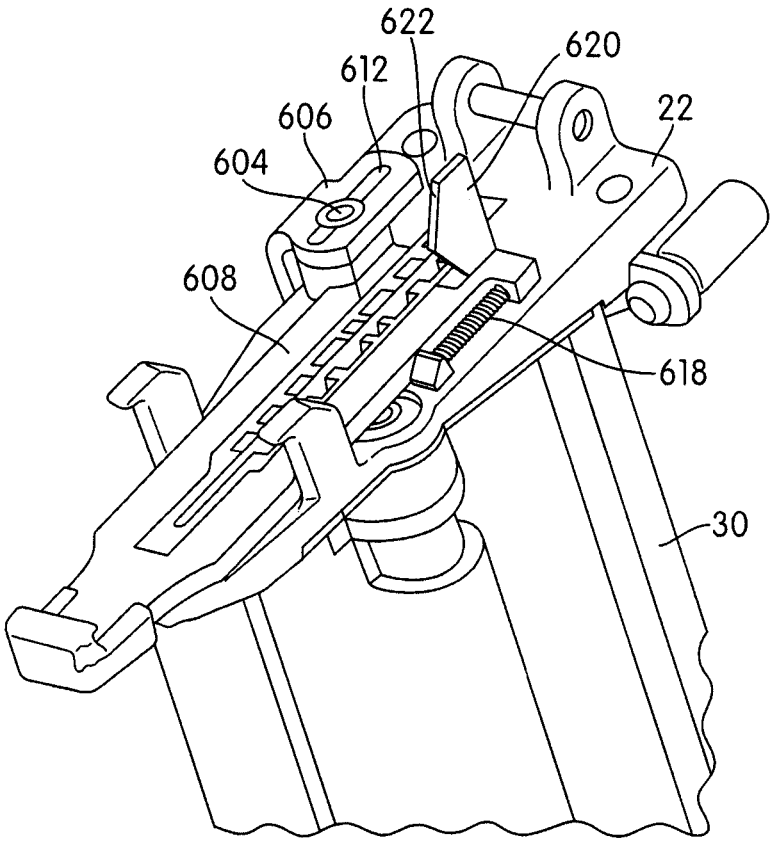
FIG. 27 illustrates the portion of the nose assembly, the contact trip assembly, and the dry fire lockout of FIG. 21, with a cover of the nose assembly removed.

To reload the magazine assembly 30 with fasteners, the magazine assembly 30 may be opened by sliding a sliding portion 32 of the magazine assembly 30 away from the nose assembly 22. As illustrated in FIG. 26, the sliding portion 32 includes an extension 620 that is configured to extend through the nose assembly 22 when the sliding portion 32 of the magazine assembly 30 is locked in a closed position after fasteners have been loaded into the magazine assembly 30. The extension 620 includes sloped surfaces 622 that are configured to engage the lower contact arm 608 and align the lower contact arm 608 with the upper contact arm 606 so that the pin 604 may reengage the enlarged circular opening 614 in the upper contact arm 606, as illustrated in FIGS. 25 and 27, regardless of depth of drive adjustment provided by the depth adjusting assembly described above.

For example, if a depth adjusting assembly is adjusted to drive fasteners shallower into the workpiece, the lower contact arm 608 will be positioned more downward and away from the housing, which may misalign the pin 604 that connects the lower contact arm 608 and the upper contact arm 606 when the magazine assembly 30 is reloaded with fasteners. By moving the lower contact arm 608 downward with the extension 620 and biasing the lower contact arm 608 upward with the contact arm spring 618, the lower contact arm 608 and the upper contact arm 606 may be realigned so as to re-engage the pin 604 with the enlarged circular opening 614 on reload of the magazine assembly 30. After the magazine assembly 30 has been closed, the lower contact arm 608 is biased to its original position by the contact arm spring 618.

Figure 28:
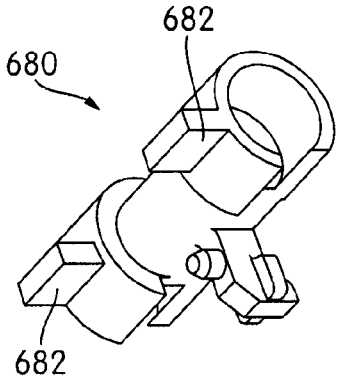
FIG. 28 illustrates a check pawl of a trigger assembly in accordance with an embodiment of the invention.
Figure 29:
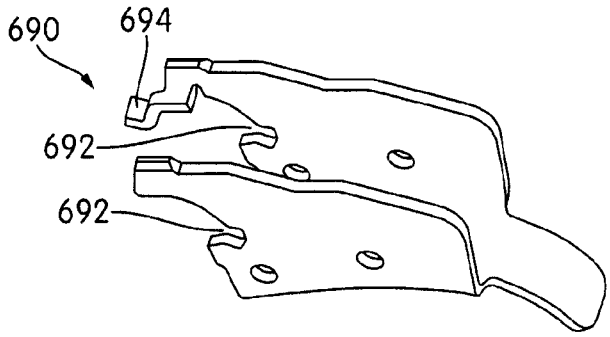
FIG. 29 illustrates an embodiment of a trigger of the trigger assembly for use with the check pawl of FIG. 28 in accordance with an embodiment of the invention.

FIG. 28 illustrates an embodiment of a check pawl 680 that may be used in any of the trigger assemblies discussed herein, and FIG. 29 illustrates an embodiment of a rotatable trigger 690 that may be used in any of the trigger assemblies discussed herein, with the exception of the trigger assembly 310 that includes a sliding trigger. The embodiments of the check pawl 680 and the trigger 690 may be particularly suitable for use in a tool 10 that includes an embodiment of a trigger lockout device 700 that is illustrated in FIGS. 30-32.

As illustrated in FIG. 28, the check pawl 680 includes a pair of surfaces 682 that are configured to engage a pair of surfaces 692 on the trigger 690, as illustrated in FIG. 29. As described above, when the check pawl is engaged in the window of the upper contact arm, and the trigger rotates downward and away from the trigger valve, a protrusion on the trigger engages the check pawl to rotate the check pawl out of the window. The illustrated embodiments of the check pawl 680 and the trigger 690 are not intended to be limiting in any way and are merely provided to illustrate how the trigger may effect rotation of the check pawl.

Figure 30:
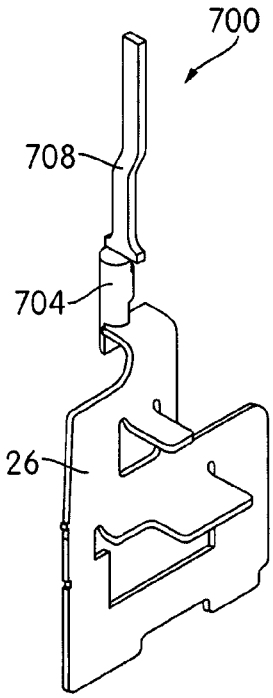
FIG. 30 illustrates a dry fire lockout in accordance with an embodiment of the invention.
Figure 32:
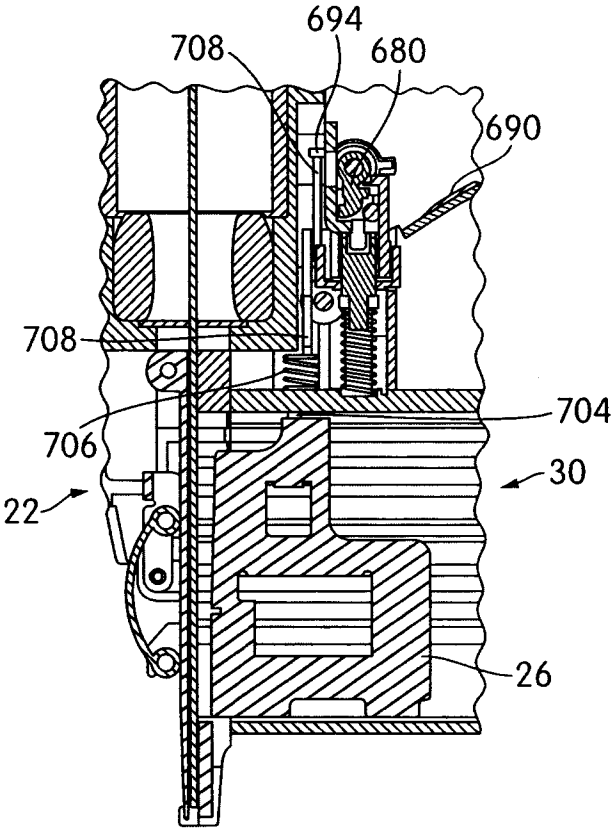
FIG. 32 illustrates the portion of the fastening tool of FIG. 31 with the dry fire lockout preventing movement of the trigger.
Figure 31:
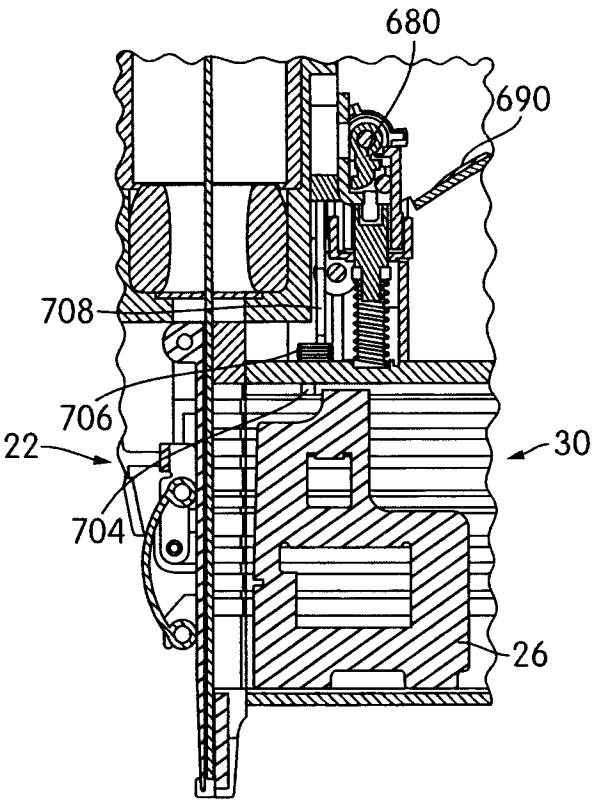
FIG. 31 illustrates a portion of the fastening tool with the dry fire lockout of FIG. 30.

Turning to FIGS. 30-32, the trigger lockout device 700 may be used with embodiments of the actuation devices described above. As discussed below, the trigger lockout device 700 is configured to lockout the trigger 68 when the number of fasteners in the magazine assembly 30 has been depleted to a predetermined number of fasteners. In an embodiment, the predetermined number of fasteners is six.

The trigger lockout device 700 includes a first portion 704, which may be in the form of a rod or pin, and a lockout spring 706 that biases the first portion 704 away from the magazine assembly 30. A lower part of the first portion 704 is configured to extend into the magazine assembly 30. A second portion in the form of a lockout arm 708 is supported by and extends upward from the first portion 704, towards the trigger 690. A protrusion 694 on the trigger 690 (illustrated in FIG. 29) is configured to extend over and engage a distal end 710 of the lockout arm 708, as illustrated in FIG. 32. When the trigger 690 is pulled or moved upward to actuate the trigger valve 62, movement of the trigger 690 causes the protrusion 694 to press down on the lockout arm 708. As long as downward movement of the first portion 704 is not blocked in the magazine assembly 30, the lockout arm 708 and first portion 704 will move downward against the upward bias of the lockout spring 706, thereby allowing the trigger 68 to operate normally. As the number of fasteners in the magazine assembly 30 is depleted, the pusher 26 in the magazine assembly 30 moves towards the nose assembly 22.

When the number of fasteners reaches the predetermined number to have the trigger lockout device 700 prevent operation of the trigger 690, the pusher 26 is positioned just below the first portion 704 so that when the trigger 690 is pulled, downward movement of the lockout arm 708 and the first portion 704 is blocked. In this condition, the trigger 690 cannot rotate and move upward any further, which prevents the trigger 690 from pressing the valve stem 66 inward to the degree that allows for actuation of the trigger valve 62.

As a result of the dry fire lockout, the tool is prevented from firing the remaining fastener and will not blank-fire. A blank-fire occurs when the engine causes the fastener driver to move through a drive stroke with no fastener present. A blank-fire may leave an unsightly indentation in the workpiece, because the driver will extend out of the nose assembly 22 (as illustrated in FIG. 2) if no fastener is present. When additional fasteners have been added to the magazine assembly 30, the pusher 26 will move out of a blocking relation with the first portion 704 so that the trigger 690 may move freely.

FIGS. 33-36 illustrate an embodiment of an actuation device 800 for the tool 10. The actuation device 800 includes a trigger assembly 810 and a contact trip assembly 830. The trigger assembly includes a trigger (not illustrated) that is supported by the housing 12, and a trigger arm or rocker 814 that is supported by the trigger. The trigger arm 814 is constructed and arranged to interact with the valve stem 66 of the trigger valve 62, as well as the contact trip assembly 830. A trigger spring 816 is positioned between the portion of the housing 12 that supports the trigger valve 62 and the trigger arm 814 and is configured to bias the trigger arm 814 and the trigger downward and away from the trigger valve 62. Similar to the embodiment illustrated in FIGS. 5-10, a proximal end of the trigger arm 814 is pivotally connected to the trigger, and a distal end 822 of the trigger arm 814 rests on top of the contact trip assembly 830. A center portion 824 of the trigger arm 814 that is in between the proximal end and the distal end 822 is configured to press against the valve stem 66 of the trigger valve 62.

Figure 33:
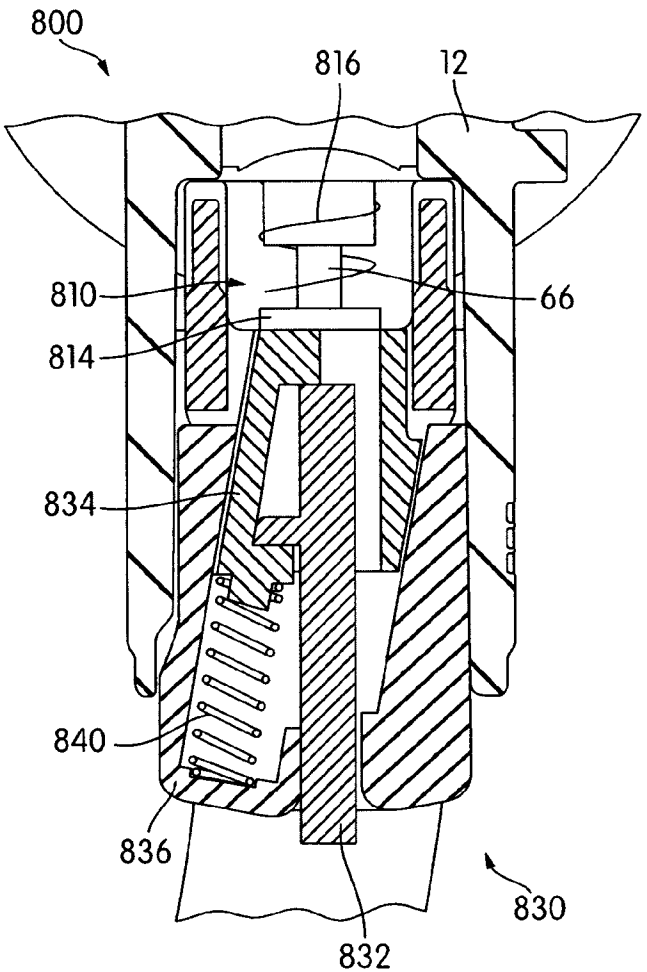
FIG. 33 illustrates a portion of an actuation device of the fastening tool according to an embodiment of the invention.

The contact trip assembly 830 includes a contact arm 832, a contact arm guide 834 operatively connected to the contact arm 832, and an upper trip guide 836 constructed and arranged to guide movement of the contact arm guide 834 and the contact arm 832. When the tool 10 is in the rest condition, the contact arm 832 is biased upward by a contact arm spring (not shown), and the contact arm guide 834 is biased upward by a guide spring 840, as illustrated in FIG. 33, while the trigger is biased downward by the trigger spring 816.

Figure 34:
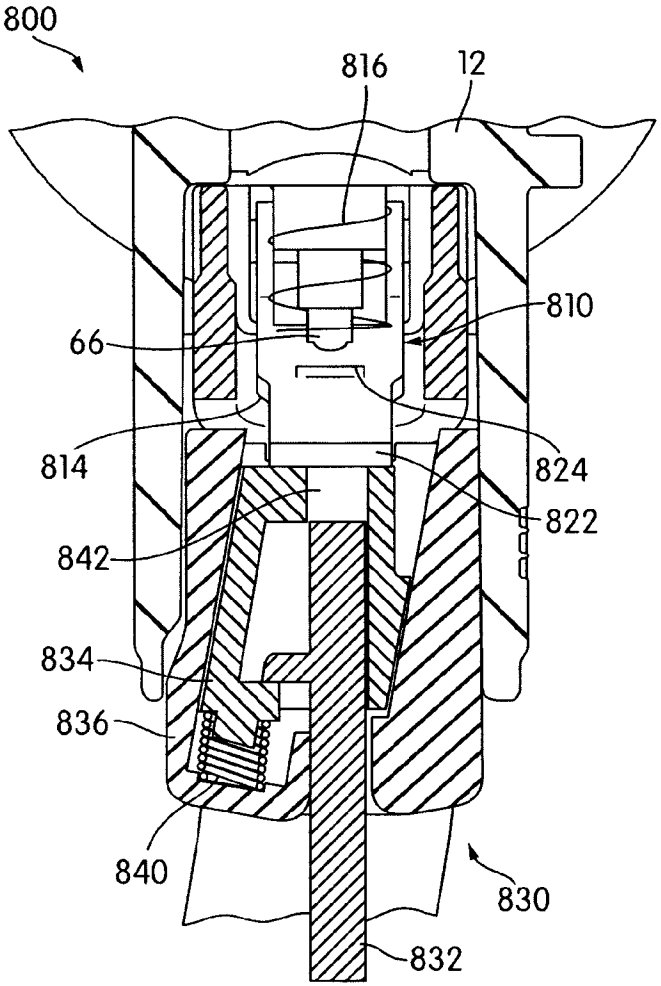
FIG. 34 illustrates the portion of the actuation device of FIG. 33 when a nose of the tool is not in contact with a workpiece and the trigger has been moved upward.
Figure 35:
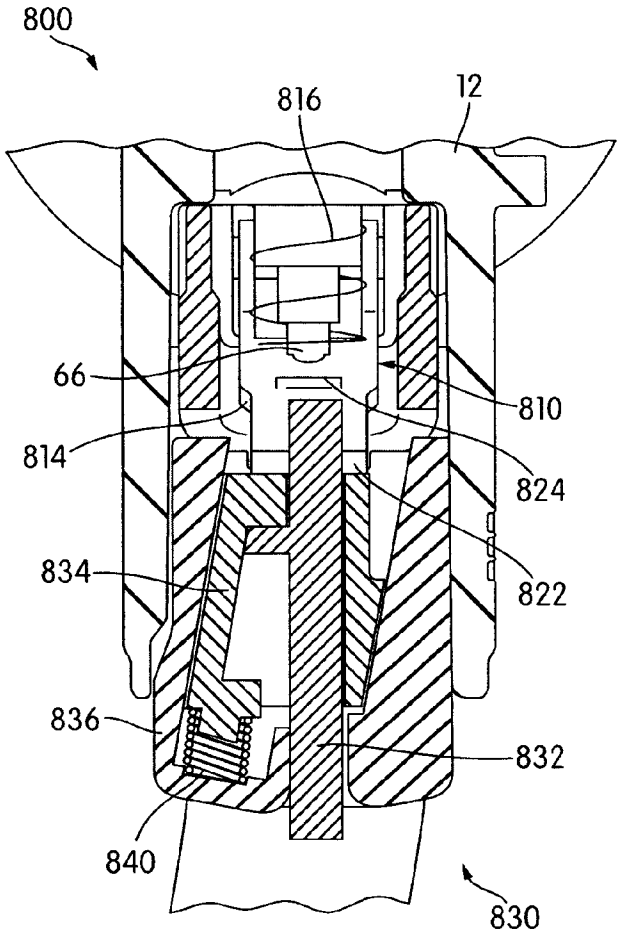
FIG. 35 illustrates the portion of the actuation device of FIG. 34 after the nose of tool has been pressed against the workpiece with the trigger still in an upward position.

FIG. 34 illustrates a condition when the contact arm 832 is not in contact with the workpiece and the trigger is pulled, i.e. moved upward towards the trigger valve 62. Because movement of the contact arm 832 is unobstructed, the tool 10 does not actuate to drive a fastener. Specifically, the trigger rotates upward and the distal end 822 of the trigger arm 814 pivots downward to contact a top end of the contact arm guide 834, thereby causing the contact arm guide 834 to slide downward. The contact arm 832 becomes aligned with a notch 842 on the contact arm guide 834, as illustrated in FIG. 34, which prevents the contact arm guide 834 from moving if the contact arm 832 is then moved upward, as illustrated in FIG. 35. Because the contact arm guide 834 does not move upward in this condition, the trigger arm 814 does not move into a position that causes the center portion 824 to press the valve stem 66. Therefore, no actuation of the trigger valve 62 occurs in the event the contact arm 832 is pressed against the workpiece after the trigger 212 has been pulled.

Figure 36:
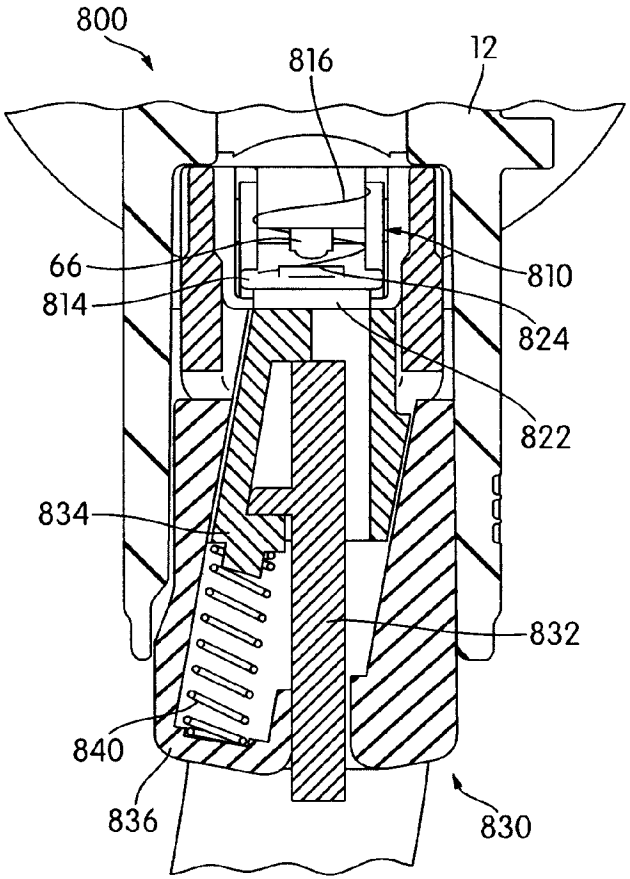
FIG. 36 illustrates the portion of the actuation device of FIG. 33 when a nose of the tool is in contact with the workpiece and the trigger is moved upward to actuate the tool.

FIG. 36 illustrates a condition in which the contact arm 832 contacts the workpiece and the trigger is moved upward towards the trigger valve 62 and valve stem 66. In this condition, the contact arm 832 will move the contact arm guide 834 and the engagement of the contact arm 832 with the workpiece and the contact arm 832 with the contact arm guide 834 will hold the distal end of the trigger arm 814 in position so that the center portion 824 of the trigger arm 814 will push the valve stem 66 upward, and cause actuation of the trigger valve 62 and the tool 10. The tool 10 will reset to rest position when the trigger is released and/or when the tool 10 is lifted from the workpiece.

Potential advantages of embodiments of the present invention described above include at least the following: improved ability to place a fastener more precisely and easier than tools with a traditional contact arm that normally extends outward. Other advantages and features will be apparent from the description and the drawings.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

What is claimed is:

1. A fastening tool comprising:

a housing having an engine receiving portion;

a drive engine located in the engine receiving portion, the drive engine comprising a cylinder and a piston reciprocally mounted within the cylinder, the piston comprising a driver configured to move along a drive axis to drive a fastener during a drive stroke;

a nose assembly carried by the housing, the nose assembly comprising a fastener drive track configured to receive the driver, and a movable portion biased in a retracted position towards the housing and movable to an extended position away from the housing;

a magazine assembly constructed and arranged to feed successively leading fasteners from a supply of fasteners contained therein into the drive track; and an actuation device configured to actuate the drive engine to initiate the drive stroke, the actuation device comprising a contact trip assembly operatively connected to the movable portion of the nose assembly, the contact trip assembly comprising a lower contact arm connected to the movable portion of the nose assembly biased in the retracted position and movable to the extended position with the moveable portion of the nose assembly, and an upper contact arm operatively connected to the lower contact arm; and a trigger assembly comprising a trigger, a trigger arm pivotally supported by the trigger and configured to interact with the upper contact arm, and a check pawl configured to engage an opening in the upper contact arm when the upper contact arm moves downward to prevent the tool from being operated in a contact trip mode.

2. The fastening tool according to claim 1, wherein the actuation device further comprises a mode selector configured to lock the check pawl in a contact trip mode position to prevent the check pawl from engaging the opening in the upper contact arm when the upper contact arm moves downward.

3. The fastening tool according to claim 2, wherein the mode selector is configured to position the check pawl in a sequential mode position to allow the check pawl to engage the opening in the upper contact arm when the upper contact arm moves downward.

4. The fastening tool according to claim 1, wherein the trigger is pivotally mounted to the housing.

5. The fastening tool according to claim 1, further comprising a trigger guide supported by the magazine assembly, wherein the trigger is supported by the trigger guide and is configured to slide linearly relative to the trigger guide.

6. The fastening tool according to claim 1, further comprising a dry fire lockout configured to prevent initiation of the drive stroke when a predetermined number of fasteners are in the magazine assembly.

7. The fastening tool according to claim 6, wherein the dry fire lockout is configured to prevent movement of the trigger.

8. The fastening tool according to claim 7, wherein the dry fire lockout comprises a first portion configured to extend into the magazine assembly and a second portion supported by the first portion and configured to interact with the trigger.

9. The fastening tool according to claim 8, wherein the magazine assembly comprises a pusher, and wherein when the first portion of the dry fire lockout is engaged with the pusher, movement of the trigger is prevented.

10. The fastening tool according to claim 6, wherein the magazine assembly comprises a pusher, and wherein the dry fire lockout includes a protrusion extending from the pusher towards the nose assembly, a lever positioned in the magazine assembly, and a pin connected to the lever, the pin being configured to connect the lower contact arm and the upper contact arm when more than the predetermined number of fasteners are in the magazine assembly and to disconnect the lower contact arm from the upper contact arm when the protrusion moves the lever when the predetermined number of fasteners are in the magazine assembly.

11. The fastening tool according to claim 10, wherein the predetermined number of fasteners is zero.

12. An actuation device for a fastening tool comprising a drive engine, the actuation device configured to actuate the drive engine to initiate a drive stroke, the actuation device comprising:

a contact trip assembly operatively connected to a movable portion of a nose assembly of the fastening tool, and biased in the retracted position and movable to the extended position with the moveable portion of the nose assembly, the contact trip assembly comprising a lower contact arm connected to the movable portion of the nose assembly, and an upper contact arm operatively connected to the lower contact arm; and a trigger assembly comprising a trigger, a trigger arm pivotally supported by the trigger and configured to interact with the upper contact arm, and a check pawl configured to engage an opening in the upper contact arm when the upper contact arm moves downward to prevent the tool from being operated in a contact trip mode.

13. The actuation device according to claim 12, further comprising a mode selector configured to lock the check pawl in a contact trip mode position to prevent the check pawl from engaging the opening in the upper contact arm when the upper contact arm moves downward.

14. The actuation device according to claim 13, wherein the mode selector is configured to position the check pawl in a sequential mode position to allow the check pawl to engage the opening in the upper contact arm when the upper contact arm moves downward.

15. The actuation device according to claim 13, wherein the trigger is configured to be pivotally mounted to a housing of the fastening tool.

16. The actuation device according to claim 13, further comprising a trigger guide configured to be supported by a magazine assembly of the fastening tool, wherein the trigger is supported by the trigger guide and is configured to slide linearly relative to the trigger guide.

17. A fastening tool comprising:

a housing having an engine receiving portion;

a drive engine located in the engine receiving portion, the drive engine comprising a cylinder and a piston reciprocally mounted within the cylinder, the piston comprising a driver configured to move along a drive axis to drive a fastener during a drive stroke;

a nose assembly carried by the housing, the nose assembly comprising a fastener drive track configured to receive the driver, and a movable portion biased in a retracted position towards the housing and movable to an extended position away from the housing;

a magazine assembly constructed and arranged to feed successively leading fasteners from a supply of fasteners contained therein into the drive track; and an actuation device configured to actuate the drive engine to initiate the drive stroke, the actuation device comprising a contact trip assembly operatively connected to the movable portion of the nose assembly, the contact trip assembly comprising a lower contact arm connected to the movable portion of the nose assembly biased in the retracted position and movable to the extended position with the moveable portion of the nose assembly, and an upper contact arm operatively connected to the lower contact arm; and a trigger assembly comprising a trigger, a trigger arm pivotally supported by the trigger and configured to interact with the upper contact arm, and a dry fire lockout configured to prevent initiation of the drive stroke when a predetermined number of fasteners are in the magazine assembly.

18. The fastening tool according to claim 17, wherein the dry fire lockout is configured to prevent movement of the trigger.

19. The fastening tool according to claim 18, wherein the dry fire lockout comprises a first portion configured to extend into the magazine assembly and a second portion supported by the first portion and configured to interact with the trigger.

20. The fastening tool according to claim 19, wherein the magazine assembly comprises a pusher, and wherein when the first portion of the dry fire lockout is engaged with the pusher, movement of the trigger is prevented.

21. The fastening tool according to claim 17, wherein the magazine assembly comprises a pusher, and wherein the dry fire lockout includes a protrusion extending from the pusher towards the nose assembly, a lever positioned in the magazine assembly, and a pin connected to the lever, the pin being configured to connect the lower contact arm and the upper contact arm when more than the predetermined number of fasteners are in the magazine assembly and to disconnect the lower contact arm from the upper contact arm when the protrusion moves the lever when the predetermined number of fasteners are in the magazine assembly.

22. The fastening tool according to claim 21, wherein the predetermined number of fasteners is zero.

* * * * *